US010384444B2

(12) United States Patent
Komamiya et al.

(10) Patent No.: US 10,384,444 B2
(45) Date of Patent: Aug. 20, 2019

(54) RECORDING APPARATUS AND RECORDING METHOD

(71) Applicant: CANON KABUSHIKI KAISHA, Tokyo (JP)

(72) Inventors: Eiji Komamiya, Kawasaki (JP); Tetsuya Edamura, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/945,510

(22) Filed: Apr. 4, 2018

(65) Prior Publication Data

US 2018/0311953 A1 Nov. 1, 2018

(30) Foreign Application Priority Data

Apr. 28, 2017 (JP) ..... 2017-089517

(51) Int. Cl.

| | |
|---|---|
| ***B41J 2/21*** | (2006.01) |
| ***B41J 2/045*** | (2006.01) |
| ***B41J 2/155*** | (2006.01) |
| ***B41J 2/205*** | (2006.01) |

(52) U.S. Cl.

CPC ..... *B41J 2/04508* (2013.01); *B41J 2/04585* (2013.01); *B41J 2/155* (2013.01); *B41J 2/2054* (2013.01); *B41J 2/2139* (2013.01); *B41J 2/2142* (2013.01); *B41J 2/2146* (2013.01)

(58) Field of Classification Search

CPC .... B41J 2/04508; B41J 2/2054; B41J 2/2139; B41J 2/155; B41J 2/04585; B41J 2/2142; B41J 2/2146

See application file for complete search history.

(56) References Cited

U.S. PATENT DOCUMENTS

| | | | | |
|---|---|---|---|---|
| 2011/0090276 | A1* | 4/2011 | Hirano | B41J 2/2132 347/14 |
| 2012/0062643 | A1* | 3/2012 | Ito | B41J 2/2139 347/19 |
| 2014/0063101 | A1* | 3/2014 | Hattori | B41J 2/2142 347/14 |

FOREIGN PATENT DOCUMENTS

| | | |
|---|---|---|
| JP | 10-006488 A | 1/1998 |
| JP | 2004-501009 A | 1/2004 |

* cited by examiner

*Primary Examiner* — Yaovi M Ameh

(74) *Attorney, Agent, or Firm* — Canon U.S.A., Inc. IP Division

(57) ABSTRACT

A recording apparatus includes a recording head including a plurality of ink discharge ports arranged in a predetermined direction, and a complementing unit configured to, according to discharge defect information identifying a defective discharge port at which a discharge defect has occurred among the plurality of ink discharge ports, determine to cause provision of complementary ink to be conducted from a different discharge port configured to discharge the ink at a different position from the identified defective discharge port, wherein the complementing unit determines to use a discharge port configured to provide the ink at a position on one side that is one of positions adjacent in the predetermined direction to a position at which the at least one discharge port provides the ink as the different discharge port for the discharge port identified as the defective discharge port.

15 Claims, 14 Drawing Sheets

RECORDING APPARATUS AND RECORDING METHOD

BACKGROUND OF THE INVENTION

Field of the invention

The present disclosure relates to a recording apparatus and a recording method.

Description of the Related Art

There is known a recording apparatus that records an image onto a recording medium by discharging ink from a recording head onto the recording medium while relatively moving at least one of the recording medium and the recording head including a discharge port array in which a plurality of discharge ports is arrayed.

In such a recording apparatus, when an ink discharge defect occurs at a part of the plurality of discharge ports, the ink provided to a region on the recording medium that corresponds to this discharge port (hereinafter referred to as a defective discharge port) becomes insufficient and an image quality of an acquired image is deteriorated thereby.

To address a problem of such a discharge defect, Japanese Patent Application Laid-Open. No. 10-6488 discusses carrying out complementary recording in the vicinity of the region on the recording medium where the image should have been recorded by the defective discharge port with use of a discharge port located at a position adjacent to the defective discharge port in a direction in which the discharge ports are arrayed, thereby complementing the discharge defect at the defective discharge port.

However, the discharge defect may be unable to be appropriately complemented with use of the discharge port adjacent to the defective discharge port depending on discharge data. If ink discharge is set to the discharge port adjacent to the defective discharge port in the first place, the ink should also be discharged from the adjacent discharge port, and this adjacent discharge port cannot be used to complement the discharge defect.

Japanese Unexamined Patent Application Publication (Translation of PCT Application) No. 2004-501009 discusses determining whether the ink discharge is set with respect to the discharge port adjacent to the defective discharge port, and causing the complementary recording to be carried out with use of a discharge port at which the ink discharge is not set.

However, Japanese Unexamined Patent Application Publication. (Translation of PCT Application) No. 2004-501009 necessitates processing such as determining whether the ink discharge is set to a plurality of discharge ports adjacent to the defective discharge port, and determining a position complementing a dot according to a result of this determination. These processing procedures need to be performed with respect to each pixel that should have been recorded by the defective discharge port, which undesirably increases a time taken for the processing, thereby raising a possibility of causing a reduction in a throughput of the recording.

The present disclosure has been made in consideration of the above-described problem, and is directed to carrying out the complementary recording with use of the discharge port adjacent to the defective discharge port while preventing or cutting down the reduction in the throughput of the recording.

The present disclosure has been made in consideration of the above-described problem, and is directed to complementing the discharge defect with use of the discharge port adjacent to the defective discharge port without excessively reducing the throughput.

SUMMARY OF THE INVENTION

According to an aspect of the present disclosure, a recording apparatus includes a recording head including a plurality of ink discharge ports arranged in a predetermined direction, a determination unit configured to, according to tone data indicating a tone of an image to be formed on a recording medium, determine whether or not to provide ink at a position corresponding to each of pixels forming the image on the recording medium, and a complementing unit configured to, according to discharge defect information identifying a defective discharge port at which a discharge defect has occurred among the plurality of ink discharge ports, determine to cause provision of complementary ink to be conducted from a different discharge port configured to discharge the ink at a different position from the identified defective discharge port. The recording apparatus controls a recording operation so as to move the recording head and the recording medium relative to each other in a direction intersecting the predetermined direction and provide the ink from the recording head onto the recording medium according to the determination made by the determination unit and the determination made by the complementing unit. With respect to at least one discharge port among the plurality of ink discharge ports, if this discharge port is identified as the defective discharge port, the complementing unit determines to use a discharge port configured to provide the ink at a complementing position on only predetermined one side that is one of positions adjacent in the predetermined direction to a position at which the at least one discharge port provides the ink, as the different discharge port. If a tone value indicated by the tone data is a tone value half as large as a maximum tone value, the determination unit determines not to discharge the ink at more than half of complementing positions, each of which is the complementing position for the at least one discharge port.

Further features and aspects of the present disclosure will become apparent from the following description of numerous example embodiments with reference to the attached drawings.

DESCRIPTION OF THE EMBODIMENTS

Figure 1:
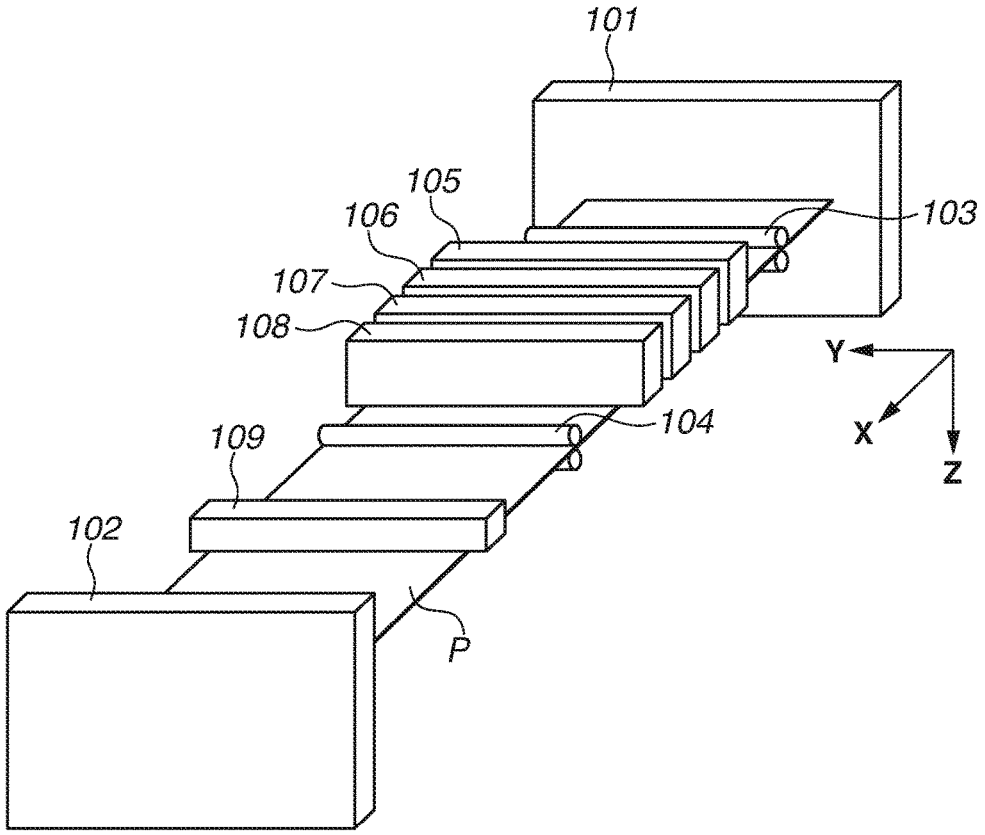
FIG. 1 is a diagram illustrating an inner configuration of a recording apparatus according to an example embodiment.

FIG. 1 is a diagram illustrating an inner configuration of an inkjet recording apparatus (hereinafter also referred to as a recording apparatus) according to a first example embodiment.

A recording medium P fed from a feeding unit 101 is conveyed at a predetermined speed in a +X direction (a conveyance direction and an intersection direction) while being sandwiched by conveyance roller pairs 103 and 104, and is discharged by a discharge unit 102. Recording heads 105 to 108 are arrayed so as to be lined up along the conveyance direction between the conveyance roller pair 103 on an upstream side and the conveyance roller pair 104 on a downstream side, and discharge ink in a Z direction according to recording data (binary recording data in this example), which is discharge data. The recording heads 105, 106, 107, and 108 discharge cyan ink, magenta ink, yellow ink, and black ink, respectively. Further, the respective colors of ink are supplied to the recording heads 105 to 108 via not-illustrated tubes.

In the present example embodiment, the recording medium P may be a continuous sheet held in a rolled form at the feeding unit 101 or may be a cut sheet cut into a standardized size in advance. In the case of the continuous sheet, after ends of recording operations by the recording heads 105 to 108, the recording medium P is cut into a predetermined length by a cutter 109 and is sorted onto discharge trays for each size at the discharge unit 102.

Figure 2:
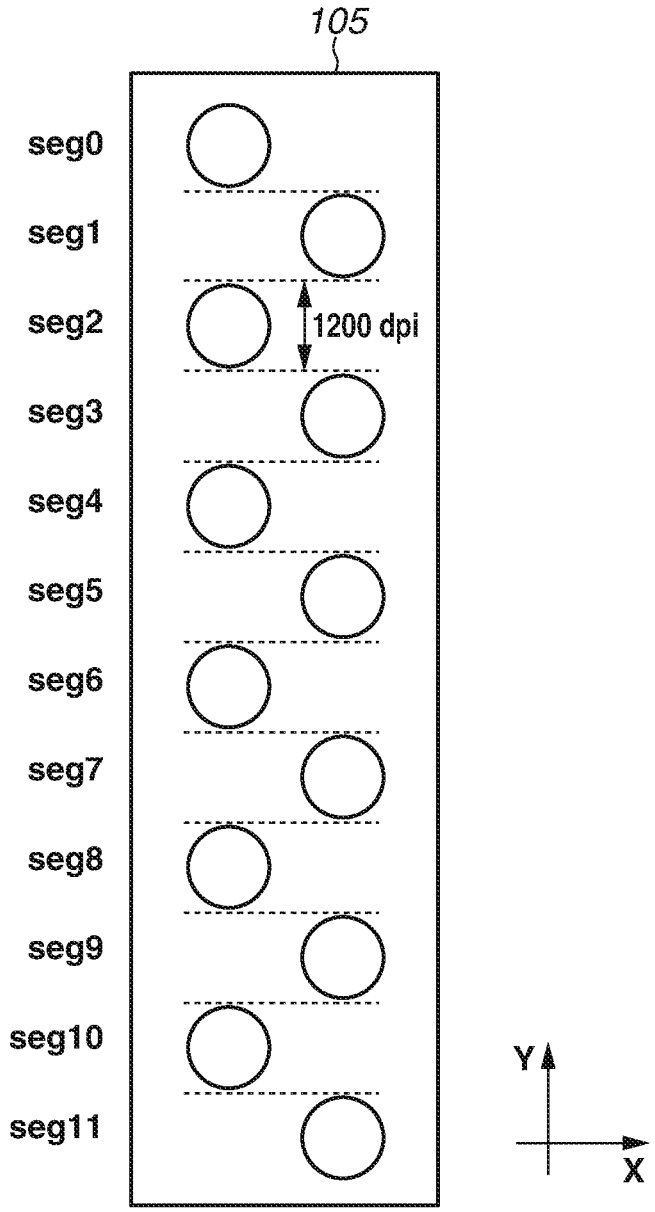
FIG. 2 is a diagram illustrating a recording head according to the example embodiment.

FIG. 2 is a diagram illustrating the recording head according to the present example embodiment. FIG. 2 illustrates only the recording head 105 of the cyan ink among the recording heads 105 to 108, but the other recording heads 106 to 108 are also configured similarly to the recording head 105. Further, an electrothermal conversion element is disposed as a recording element at a position (inside the recording head 105) facing each of discharge ports 30 arrayed on the recording head 105. The recording head 105 generates thermal energy for performing an operation of discharging the ink by driving this electrothermal conversion element. Further, the recording head 105 can also use a piezoelectric element, an electrostatic element, or a microelectromechanical system (MEMS) element, instead of the electrothermal conversion element.

The recording head 105 includes a discharge port array in which twelve discharge ports seg0 to seg11 for discharging the ink are arrayed along a Y direction (an array direction and a predetermined direction) intersecting the X direction. More specifically, a row formed by seg0, seg2, seg4, seg6, seg8, and seg10, and a row formed by seg1, seg3, seg5, seg7, seg9, and seg11 are disposed at positions shifted from each other by 1200 dpi in the Y direction, and form one discharge port array. FIG. 2 illustrates the recording head 105 including the twelve discharge ports seg0 to seg11 for simplicity, but, actually, the recording head 105 includes the discharge ports arrayed in a range that allows data to be recorded on an entire width of the recording medium P in the Y direction. Further, FIG. 2 illustrates a configuration in which one discharge port array is formed by two rows, but, for example, one discharge port array may be formed by only one row or may be formed by four rows.

Figure 3:
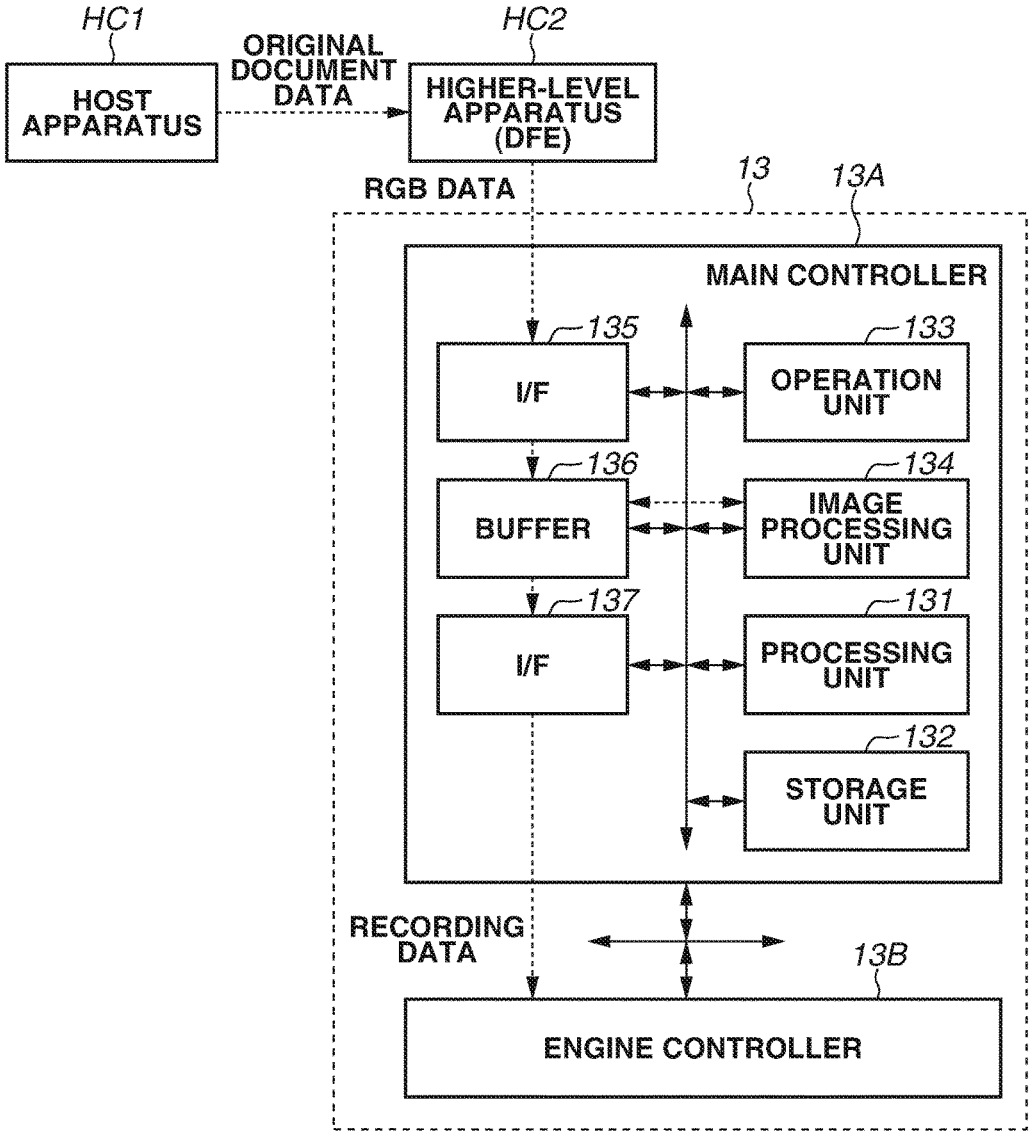
FIG. 3 is a block diagram illustrating a recording control system according to the example embodiment.

FIG. 3 is a block diagram illustrating a recording control system according to the present example embodiment.

A recording control system 13 in the recording apparatus is communicably connected to a higher-level apparatus (digital front end (DFE)) HC2, and the higher-level apparatus HC2 is communicably connected to a host apparatus HC1.

Original document data, which serves as a source of a recorded image, is generated or stored in the host apparatus HC1. The original document data here is generated in the form of an electronic file, such as a document file and an image file. This original document data is transmitted to the higher-level apparatus HC2, and the higher-level apparatus HC2 converts the received original document data into a data format usable by the recording control system 13, such as image data expressing an image as red, green, and blue (ROB). The data after the conversion is transmitted from the higher-level apparatus HC2 to the recording control system. 13 in the recording apparatus.

The recording control system 13 is broadly divided into a main controller 13A and an engine controller 13B. The main controller 13A includes a processing unit 131, a storage unit 132, an operation unit 133, an image processing nit 134, a communication interface (I/F) 135, a buffer 136, and a communication I/F 137.

The processing unit 131 is a processor, such as a central processing unit (CPU), and executes a program stored in the storage unit 132 to control the entire main controller 13A. The storage unit 132 is a storage device, such as a random access memory (RAM), a read only memory (ROM), a hard disk, and a solid-state drive (SSD). The storage unit 132 stores the program to be executed by the processing unit 131 and data therein, and further, provides a work area to the processing unit 131. The operation unit 133 is an input device, such as a touch panel, a keyboard, and a mouse, and receives an instruction of a user.

The image processing unit 134 is, for example, an electronic circuit including an image processing processor. The buffer 136 is, for example, a RAM, a hard disk, or an SSD. The communication I/F 135 communicates with the higher-level apparatus HC2, and the communication I/F 137 communicates with the engine controller 13B. In FIG. 3, dashed arrows each indicate an example a flow of processing of the data input to the recording control system 13. The image data received from the higher-level apparatus HC2 via the communication. I/F 135 is accumulated in the buffer 136. The image processing unit 134 reads out the data from the buffer 136, generates the recording data to be used by a print engine by performing predetermined image processing on the read data, and stores the generated recording data into the buffer 136 again.

Then, the recording data after the image processing that is stored in the buffer 136 is transmitted from the communication I/F 137 to the controller 13B. After that, the recording element disposed at each of the recording heads 105 to 108 is driven by the engine controller 13B based on the recording data, by which the recording operation is performed.

In the present example, the recording control system 13 has been described as being configured to include one unit each of the processing unit 131, the storage unit 132, the image processing unit 134, and the buffer 136, but may be configured to include a plurality of processing units 131, a plurality of storage units 132, a plurality of image processing units 134, and a plurality of buffers 136.

(Image Processing)

Figure 4:
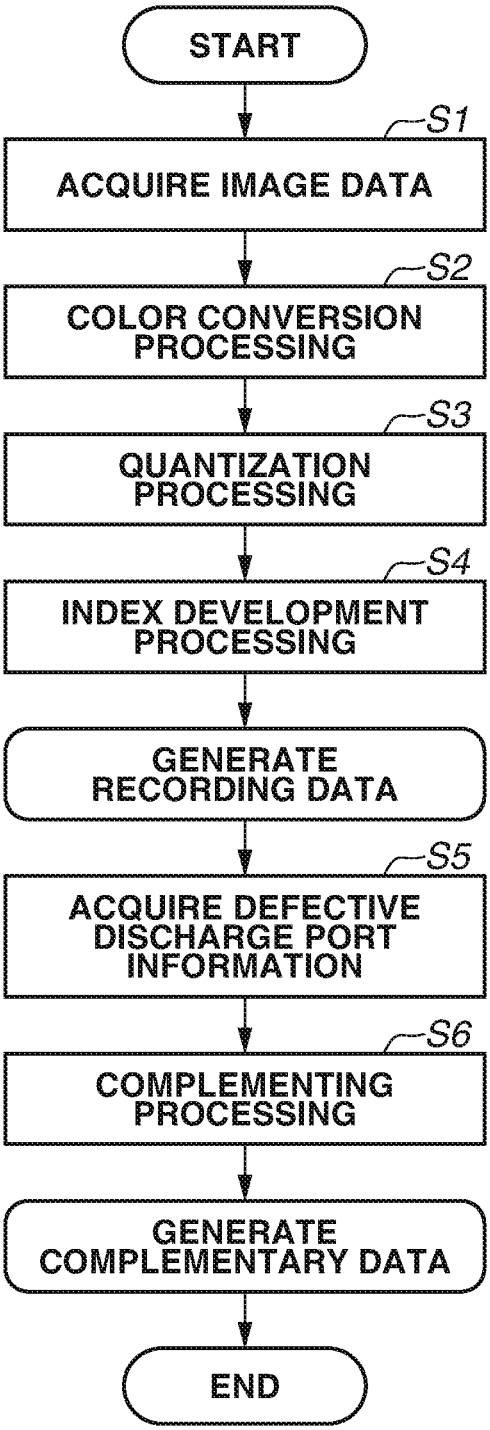
FIG. 4 is a flowchart illustrating how image processing proceeds according to the example embodiment.

FIG. 4 is a flowchart of a control program of data processing performed by the image processing unit 134 according to the present example embodiment.

When the image processing is started, first, in step S1, the image processing unit 134 acquires the image data (the RGB data) read out from the buffer 136. Now, in the present example embodiment, the image data is formed by 8-bit information for each of R, G, and B values. Further, in the present example embodiment, the image data has a data resolution of 600 dpi×600 dpi. The image data indicates any of 256 values from 0 to 255 with respect to each pixel in the data resolution of 600 dpi×600 dpi.

Next, in step S2, the image processing unit 134 performs color conversion processing for converting the image data into ink color data (cyan (C), magenta (M), yellow (Y), and black (K) data) corresponding to the ink colors to be used in the recording. By this color conversion processing, the ink color data formed by 8-bit information for each of C, M, Y, and K values is generated. The ink color data indicates any of 256 values from 0 to 255 with respect to each pixel in the data resolution of 600 dpi×600 dpi.

Next, in step S3, the image processing unit 134 quantizes the ink color data, thereby generating tone data formed by 3-bit information for each of the C, M, Y, and Y values. The dither method, the error diffusion method, or the like can be performed as this quantization processing. In the present example embodiment, the tone data having the data resolution of 600 dpi×600 dpi is generated by the quantization processing. The tone data indicates any of 5 values from 0 to 4 levels (tone values of 5 steps) with respect to each pixel in the data resolution of 600 dpi×600 dpi.

Next, in step S4, the image processing unit 134 performs index development processing on the tone data, thereby generating the recording data formed by 1-bit information for each of C, M, Y, and K. The recording data generated by the index development processing has a data resolution of 1200 dpi×1200 dpi. More specifically, the recording data indicates whether or not to discharge the ink with respect to each pixel in the data resolution of 1200 dpi×1200 dpi.

In the present example embodiment, different index patterns are used according to the tone value indicated by the tone data in the index development processing in step S4. The index pattern refers to a pattern defining the number of pixel(s) and a position of a pixel at which the ink is discharged according to the tone value. Details of these index patterns and the index development processing in step S4 will be described below.

Next, in step S5, the image processing unit 134 acquires information indicating a discharge port at which an ink discharge defect has occurred (hereinafter also referred to as a defective discharge port). This information indicating the defective discharge port is stored in the RAM of the storage unit 132 in advance before the processing illustrated in FIG. 4 is started. The ink discharge defect at the defective discharge port includes a failure to discharge the ink, insufficiency of a discharge amount of the ink, and a deviation in a discharge direction of the ink.

Conventionally known various methods can be used to identify the defective discharge port. One example thereof is to record a test patch by discharging the ink from all of the discharge ports of one recording head, and determine a location where the image is absent on this test patch by an optical sensor or by user's visual inspection. Then, a discharge port corresponding to this absence can be regarded as the defective discharge port.

Further, for example, the recording apparatus may be equipped with a sensor that outputs and receives light passing through immediately below the discharge ports while causing the ink to be discharged from all of the discharge ports of one recording head. In this case, at a discharge port at which no ink discharge defect has occurred (hereinafter referred to as a non-defective discharge port), the ink is discharged and therefore the light is shielded, so that the sensor does not receive the output light. However, at the defective discharge port, the light passes through immediately below the discharge port, so that the sensor receives the output light. The defective discharge port can also be identified in this manner.

The information indicating the defective discharge port identified in this manner is stored in the RAM in advance, and this information is read out in step S5.

Then, step S6, the image processing unit 134 performs complementing processing for complementing the discharge defect at the defective discharge port, thereby generating complementary data. A detail of this complementing processing, will also be described below.

After the above-described processing, the recording control system 13 generates the data to be actually used in the recording based on the generated recording data and the complementary data and transmits this data to the engine controller 13B, by which the recording operation is performed on the recording medium P from each of the recording heads 105 to 108 based on this data. The recording control system 13 may transmit the recording data and the complementary data to the engine controller 13B, and perform the recording operation while directly using these pieces of recording data and complementary data. Alternatively, the recording control system 13 may be configured to transmit the data to the engine controller 13B after combining the recording data and the complementary data into one piece of data by, for example, overwriting the generated recording data with the complementary data.

In the above description, the present example embodiment has been described as being configured in such a manner that the image processing unit 134 in the recording apparatus performs all of the processing procedures steps S1 to S6, but can also perform these processing procedures by another configuration. For example, the present example embodiment may be configured in such a manner that the host apparatus HC1 performs all of the processing procedures in steps S1 to S6. Alternatively, the present example embodiment may be configured in such a manner that, for example, the host apparatus HC1 performs the processing procedures up to the color conversion processing (step S2) and the recording apparatus performs the quantization processing (step S3) and the processing procedures after that. Alternatively, needless to say, the higher-level apparatus HC2 may perform a part or all of the processing procedures in steps S1 to S6.

(Index Development Processing)

The detail of the index development processing performed in the present example embodiment will be described.

Figure 5:
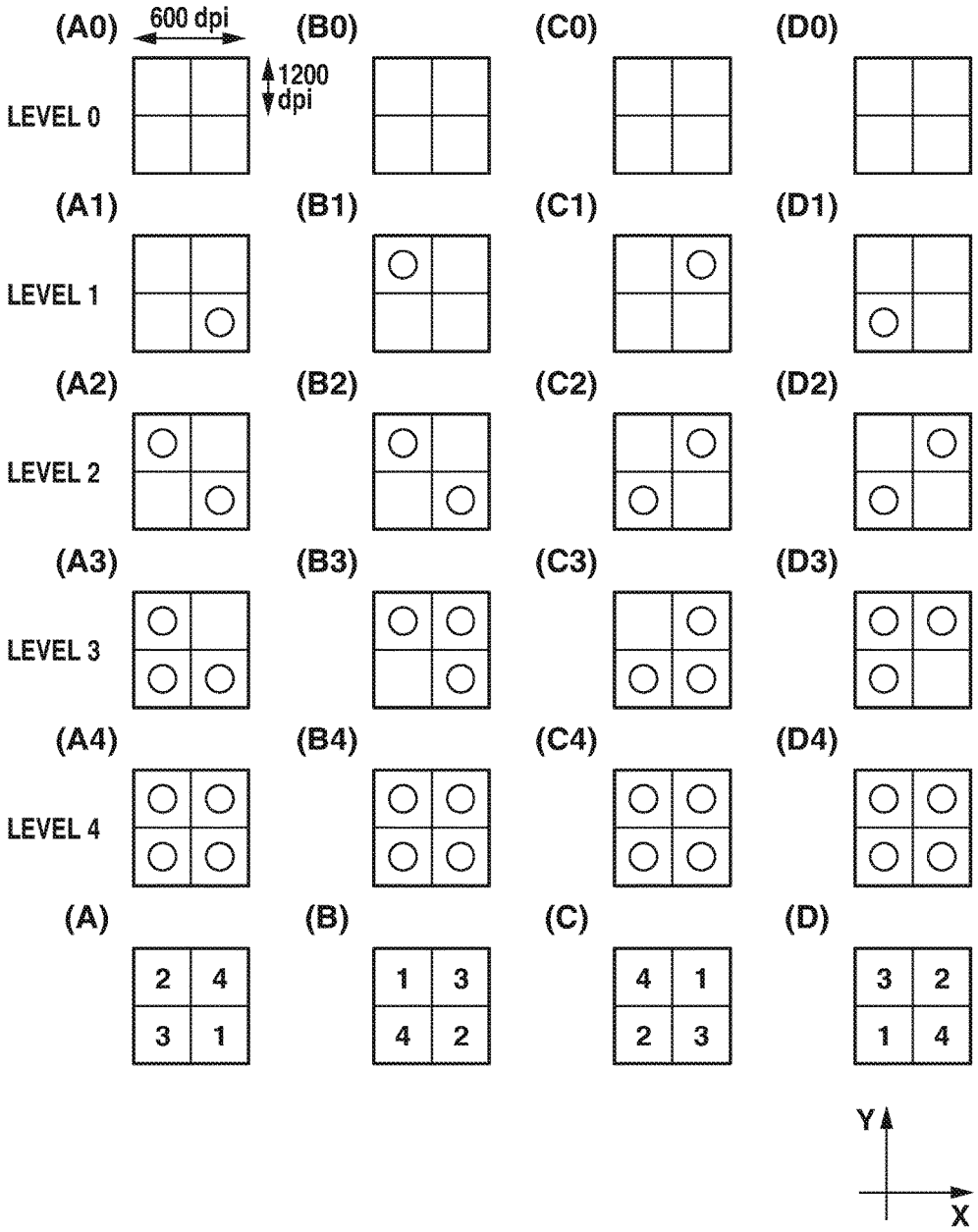
FIG. 5 is a schematic diagram illustrating index patterns according to the example embodiment.

FIG. 5 is a schematic diagram illustrating the index patterns used in the present example embodiment. In the present example embodiment, the recording apparatus has four types of index patterns defining the number of pixel(s) and the position of the pixel at which the ink discharge is set according to the tone value of the tone data of the data resolution of 600 dpi×600 dpi, i.e., tone value of the tone data in a pixel group formed by 2 pixels×2 pixels, and selects and employs these index patterns according to a position of the pixel group.

(A) to (D) in FIG. 5 illustrate the four types of index patterns used in the present example embodiment. A number in each of the pixels indicate a threshold value for determining whether or not to discharge the ink compared to the tone value of the tone data. More specifically, if the tone value matches or exceeds the threshold value in each of the pixels, the ink discharge is set with respect to this pixel, and, if the tone value is smaller than the threshold value, inexecution of the ink discharge is set with respect to this pixel.

Now, each of the four types of index patterns illustrated in (A) to (D) of FIG. 5 is set in such a manner that the ink is discharged into the pixel group by as much as the number according to the tone value of the input tone data. Further, the four types of index patterns illustrated in (A) to (D) of FIG. 5 are set in such a manner that the ink is discharged at different positions in the pixel group from one another if the tone value of the input tone data is the same among them. Further, each of the four types of index patterns illustrated in (A) to (D) of FIG. 5 is set in such a manner that, when the tone value of the tone data is a certain value, the ink is discharged at another one pixel position in addition to a pixel position at which the ink would be discharged when the tone value of the tone data is a value lower than this value by one tone.

For example, in the index pattern illustrated in (A) of FIG. 5 (hereinafter referred to as an index pattern A), threshold values "1", "2", "3", and "4" are set for a lower right pixel, an upper left pixel, a lower left pixel, and an upper right pixel, respectively.

Therefore, if tone data having the tone value of the level 0 is input, the inexecution of the ink discharge is set at all of 2 pixels×2 pixels in the pixel group ((A0) of FIG. 5). Further, if tone data having the tone value of the level 1 is input, the ink discharge is set at only the lower right pixel for which the threshold value "1" is set ((A1) of FIG. 5). Further, if tone data having the tone value of the level 2 is input, the ink discharge is set at the upper left pixel for which the threshold value "2" is set in addition to the lower right pixel for which the threshold value "1" is set ((A2) of FIG. 5). Further, if tone data having the toner value of the level 3 is input, the ink discharge is set at the lower left pixel for which the threshold value "3" is set in addition to the lower right and upper left pixels for which the threshold values "1" and "2" are set, respectively ((A3) of FIG. 5). Then, if tone data having the tone value of the level 4 is input, the ink discharge is set at all of 2 pixels×2 pixels in the pixel group ((A4) of FIG. 5).

The same also applies to the index patterns respectively illustrated in (B), (C), and (D) of FIG. 5 (hereinafter referred to as an index pattern B, an index pattern C, and an index pattern D, respectively).

For example, if the index pattern B is used, the inexecution of the ink discharge is set at all of the pixels for the level 0 ((B0) of FIG. 5). Then, the ink discharge is set at only the upper left pixel for the level 1 ((B1) of FIG. 5), at the upper left and lower right pixels for the level 2 ((B2) of FIG. 5), and at the upper left, lower right, and upper right pixels for the level 3 ((B3) of FIG. 5). Then, the ink discharge is set at all of the pixels for the level 4 ((B4) of FIG. 5).

Further, if the index pattern C is used, the inexecution of the ink discharge is set at all of the pixels for the level 0 ((CO) of FIG. 5). Then, the ink discharge is set at only the upper right pixel for the level 1 ((C1) of FIG. 5), at the upper right and lower left pixels for the level 2 ((C2) of FIG. 5), and at the upper right, lower left, and lower right pixels for the level 3 ((C3) of FIG. 5). Then, the ink discharge is set at all of the pixels for the level 4 ((C4) of FIG. 5).

Further, if the index pattern D is used, the inexecution of the ink discharge is set at all of the pixels for the level 0 ((DO) of FIG. 5). Then, the ink discharge is set at only the lower left pixel for the level ((D1) of FIG. 5), at the lower left and upper right pixels for the level 2 ((D2) of FIG. 5), and at the lower left, upper right, and upper left pixels for the level 3 ((D3) of FIG. 5). Then, the ink discharge is set at all of the pixels for the level 4 ((D4) of FIG. 5).

Then, as understood from FIG. 5, the index patterns A to D are set in such a manner that any of the pixels for which the threshold values "1" and "2" are set are not located adjacent to each other in the Y direction within the same index pattern.

In the present example embodiment, the above-described index patterns A to D are arranged according to a predetermined arrangement pattern, and the index development is carried out on the tone data according to each of the arranged index patterns, by which the recording data is generated.

In the present example embodiment, the index patterns A to D are arranged in such a manner that the pixels at which the ink discharge is set are not located adjacent to each other in the Y direction when tone data having a tone value of the threshold value "2" or smaller is input.

Figure 6A:
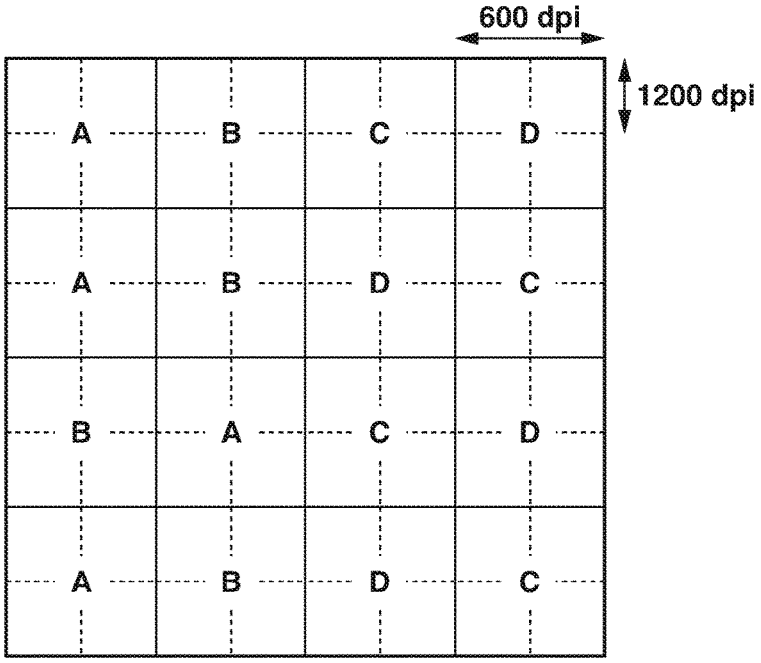
FIGS. 6A and 6B are diagrams illustrating one example of recording data generated in the example embodiment.
Figure 6B:
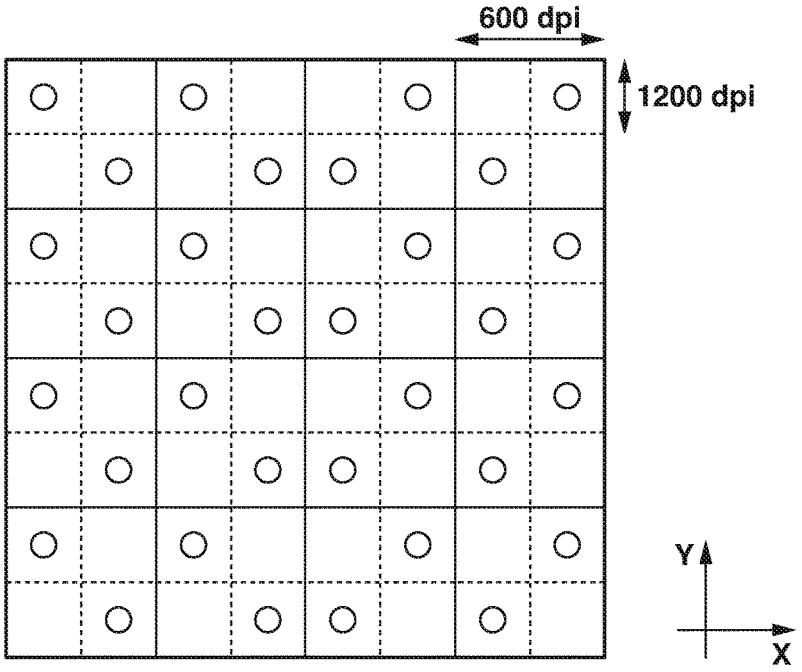

FIG. 6A illustrates the arrangement pattern of the index patterns A to D according to the present example embodiment. Further, FIG. 6B schematically illustrates the recording data generated when the input tone data indicates that the tone value of the level 2 is allocated to each of the pixel groups, in the case where the index patterns A to D are arranged according to the arrangement pattern illustrated in FIG. 6A. Each of pixels with circle marks written therein and each of pixels without anything written therein in FIG. 6B indicate the pixel at which the ink discharge is set and the pixel at which the inexecution of the ink discharge is set, respectively. Positions of these pixels correspond to positions of ink dots formed on the recording medium P. FIGS. 6A and 6B illustrate processing on a region of 8 pixels×8 pixels (a predetermined region) on the recording medium P for simplicity.

For example, as illustrated in FIG. 6A, the index pattern A is arranged at an uppermost and leftmost pixel group in the present example embodiment. Therefore, the input of the tone data having the tone value of the level 2 leads to a setting of the ink discharge at the upper left and lower right pixels in the uppermost and leftmost pixel group as illustrated in (A2) of FIG. 5.

Further, the index pattern A is also arranged at a pixel group that is the first from the left and the second from the top. Therefore, the input of the tone data having the tone value of the level 2 leads to a setting of the ink discharge at the upper left and lower right pixels in the pixel group that is the first from the left and the second from the top as illustrated in (A2) of FIG. 5.

Further, the index pattern B is arranged at a pixel group that is the first from the left and the second from the bottom. Therefore, the input of the tone data having the tone value of the level 2 leads to a setting of the ink discharge at the upper left and lower right pixels in the pixel group that is the first from the left and the second from the bottom as illustrated in (B2) of FIG. 5.

With regard to the other pixel groups, the input of the tone data having the tone value of the level 2 to each of the pixel groups also leads to a setting of the ink discharge with use of the index pattern arranged at each the pixel groups as illustrated in FIG. 6A and a setting of the ink discharge with respect to each of the pixels as illustrated in FIG. 6B.

Now, as understood from FIG. 6B, using the index patterns A to D illustrated in FIG. 5 and employing each of the index patterns A to D according to the arrangement pattern illustrated in FIG. 6A allows the recording data to be generated in such a manner that the pixels at which the ink discharge is set are not located adjacent to each other in the Y direction when the tone data having the tone value of the threshold value "2" or smaller is input.

(Complementing Processing)

The complementing processing performed in the present example embodiment will be described in detail.

In the present example embodiment, when the information indicating the defective discharge port is acquired in step S5, the recording apparatus generates complementary data for complementing the discharge defect thereof with use of the non-defective discharge port adjacent to the defective discharge port on a downstream side in the Y direction.

Figure 7:
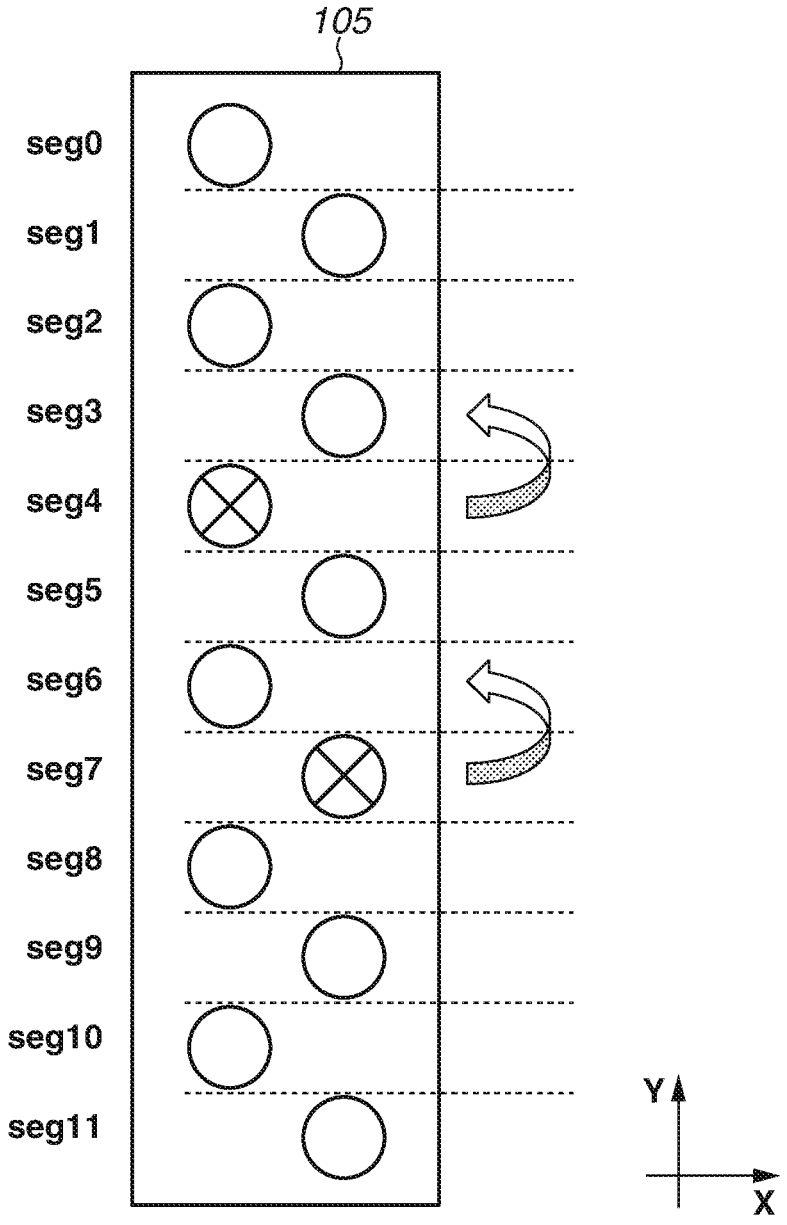
FIG. 7 is a schematic diagram illustrating complementing processing according to the example embodiment.

FIG. 7 is a schematic diagram illustrating the complementing processing according to the present example embodiment.

In the present example, the complementing processing will be described assuming that the discharge ports seg4 and seg7 among the discharge ports seg0 to seg11 are the defective discharge ports.

In this case, if the defective discharge port seg4 is set to discharge the ink with respect to a certain pixel by the recording data, the recording apparatus generates the complementary data so as to set the ink discharge at a pixel adjacent to this pixel on the downstream side in the Y direction with use of the non-defective discharge port seg3 adjacent to the defective discharge port seg4 on the downstream side in the Y direction.

Further, if the defective discharge port seg7 is set to discharge the ink with respect to a certain pixel by the recording data, the recording apparatus generates the complementary data so as to set the ink discharge at a pixel adjacent to this pixel on the downstream side in the Y direction with use of the non-defective discharge port seg6 adjacent to the defective discharge port seg7 on the downstream side in the Y direction.

In this manner, the recording apparatus can complement the discharge defects at the defective discharge ports seg4 and seg7 with use of the adjacent non-defective discharge ports seg3 and seg6, thereby succeeding in preventing or reducing the deterioration of the image quality. The discharge port to be used to complement the discharge defect when the discharge defect has occurred at some discharge port is set independently of the quantization processing and the index development processing. Further referring again to FIG. 6B, a pixel on only one side that is one of a pixel adjacent on an upper side and a pixel adjacent on a lower side in the Y direction can be used to complement the discharge defect with respect to one pixel. In other words, both of the pixels are not selected as a complementing source, and only one of them is determined to be used as the complementary pixel. The recording apparatus can store, as complementing source information, information that sets the discharge port to be used to complement the discharge defect when the discharge defect has occurred with respect to each of the discharge ports into the storage unit 132 in advance, and determine the complementing source by referring to this information. Further, the complementing source information may set the discharge port to be used to complement the discharge defect in such a manner that the position at which the complementary ink is discharged is changed according to a coordinate of the position an the recording medium P in the X direction at which the ink should have been discharged with respect to each of the discharge ports. For example, if the discharge port seg4 has the discharge defect, the complementary discharge port may be determined to be seg3 for some position in the X direction while being determined to be segue for another position the X direction.

(Processing for Generating Complementary Data)

Next, the complementary data generated when the index development processing and the complementing processing according to the above-described present example embodiment are performed will be described in detail with reference to FIGS. 8A and 8B. Pixels with circle marks written therein in FIGS. 8A and 8B each correspond to the non-defective discharge port and indicate the pixel at which the ink discharge is set by the recording data. Further, pixels with X marks written therein each correspond to the defective discharge port and indicate the pixel at which the ink discharge is set by the recording data. Further, pixels with triangle marks written therein each correspond to the non-defective discharge port and indicate the pixel at which the ink discharge is set by the complementary data.

Figure 8A:
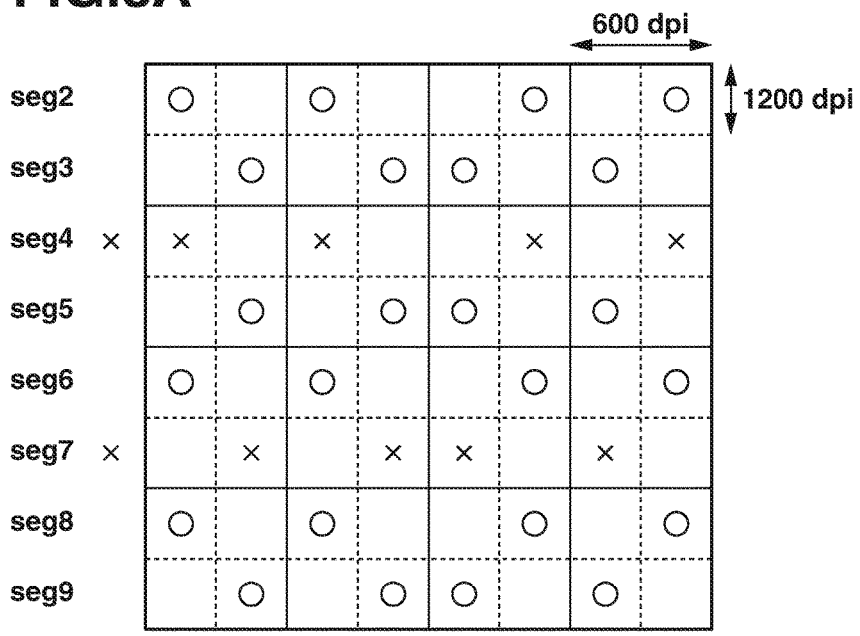
FIGS. 8A and 8B are diagrams illustrating one example of complementary data generated in the example embodiment.

FIG. 8A illustrates pixels at which ink discharge defects occur when the recording data that sets the ink discharge at the positions like the examples illustrated in FIG. 6B is generated by the index development processing according to the present example embodiment, in the case where the defective discharge ports have occurred as illustrated in FIG. 7.

In FIG. 7, the discharge ports seg4 and seg7 are the defective discharge ports, and therefore the discharge amount of the ink undesirably falls short at the pixels corresponding to the defective discharge ports seg4 and seg7 (the pixels with the X marks written therein in FIG. 8A) among the pixels at which the ink discharge is set by the recording data illustrated in FIG. 6B.

Figure 8B:
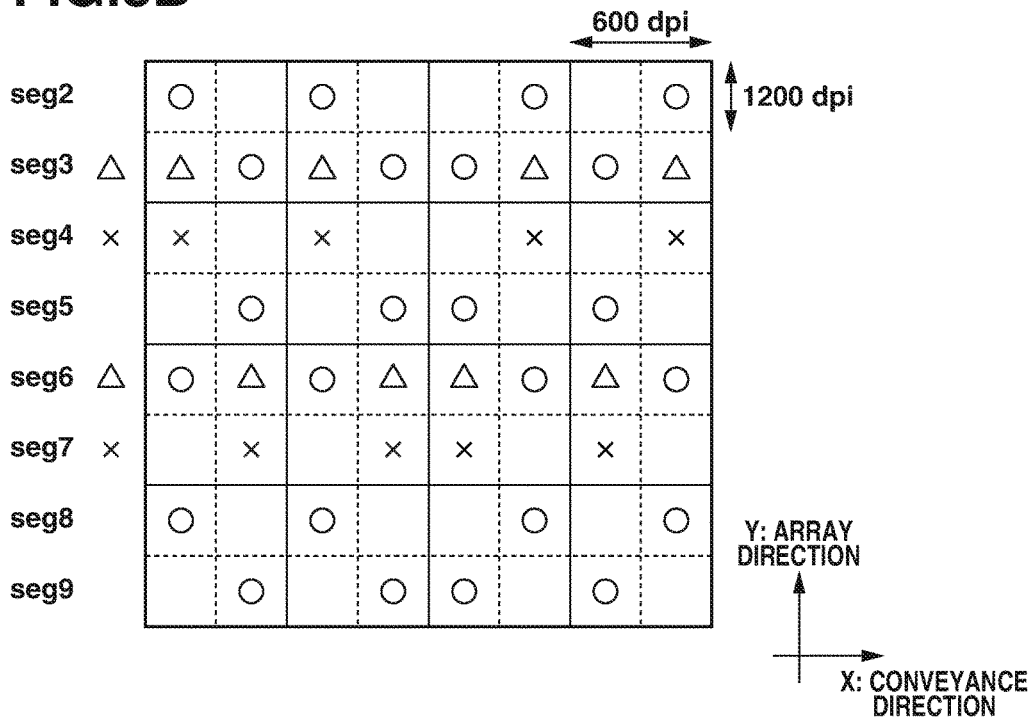

FIG. 8B illustrates the complementary data generated by performing the complementing processing according to the present example embodiment in the case illustrated in FIG. 8A.

As described above, in the present example embodiment, the discharge defect at the defective discharge port seg4 and the discharge defect at the defective discharge port seg7 are complemented with use of the non-defective discharge port seg3 and the non-defective discharge port seg6, respectively.

Then, in the present example embodiment, as illustrated in FIG. 8A, the recording data is generated in such a manner that the ink is not discharged with respect to the pixels adjacent on the downstream side in the Y direction to the pixels at which the ink discharge from the defective discharge ports seg4 and seg7 is set by the recording data (the pixels with the X marks written therein). Therefore, the complementary data can be generated in such a manner that the ink is discharged at these adjacent pixels. This means that, as illustrated in FIG. 8B, the complementing processing according to the present example embodiment results in generation of the complementary data in such a manner that, with respect to all of the pixels at which the ink discharge from the defective discharge ports is set (the pixels with the X marks written therein in FIG. 8B), the ink is discharged with respect to the pixels adjacent to these pixels an the downstream side in the Y direction (the pixels with the triangle marks written therein in FIG. 8B).

In the above-described manner, according to the present example embodiment, the recording apparatus becomes able to, with respect to all of the pixels corresponding to the defective discharge ports and set to be subjected to the ink discharge by the recording data, set the complementary discharge with respect to the pixels adjacent to these pixels in the Y direction. As a result, the deterioration of the image quality due to the discharge defect can be effectively prevented.

Next, a comparison configuration to be compared with the first example embodiment will be described.

(Index Development Processing)

In the comparison configuration, the index patterns A to D are arranged in such a manner that the pixels at which the ink discharge is set are located adjacent to each other in the Y direction when the tone data having the tone value of the threshold value "2" or smaller is input.

Figure 9A:
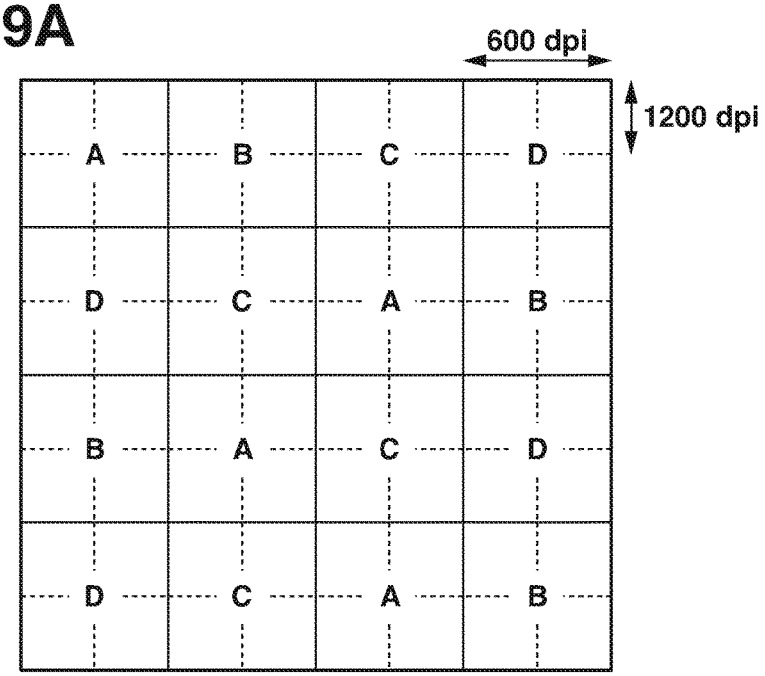
FIGS. 9A and 9B are diagrams illustrating one example of recording data generated in a comparison configuration.
Figure 9B:
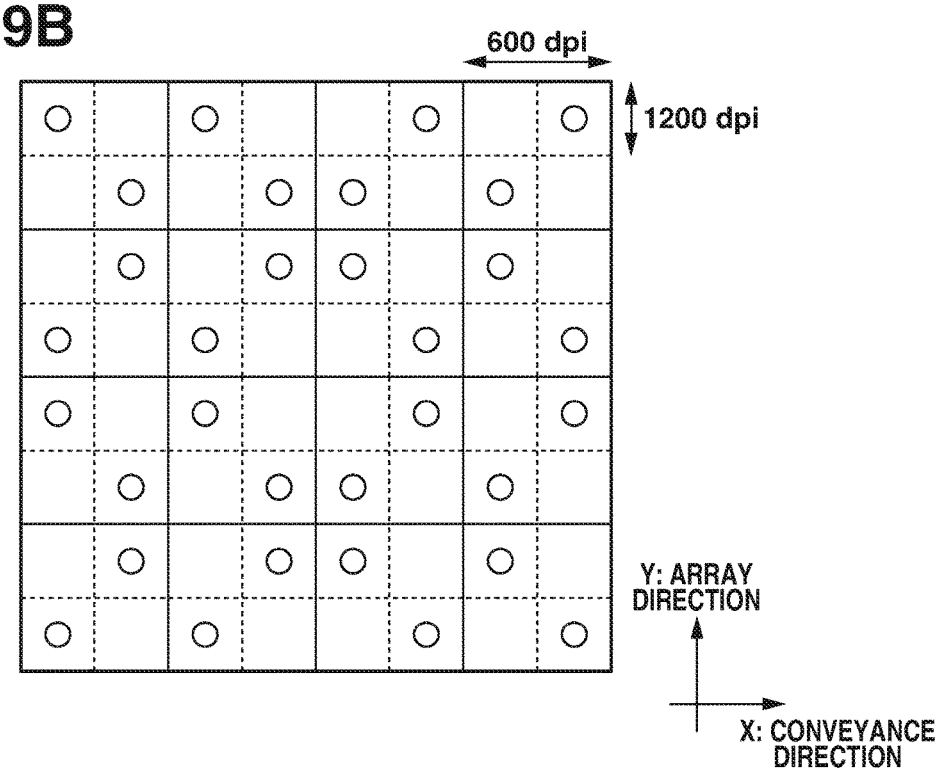

FIG. 9A illustrates the arrangement pattern of the index patterns A to D according to the comparison configuration. Further, FIG. 9B schematically illustrates recording data generated when the input tone data indicates that the tone value of the level 2 is allocated to each of the pixel groups, in the case where the index patterns A to D are arranged according to the arrangement pattern illustrated in FIG. 9A. Each of pixels with circle marks written therein and each of pixels without anything written therein in FIG. 9B indicate the pixel at which the ink discharge is set and the pixel at which the inexecution of the ink discharge is set, respectively. FIGS. 9A and 9B illustrate processing performed on the data corresponding to the region having the size of 8 pixels×8 pixels (the predetermined region) on the recording medium P for simplicity.

For example, as illustrated in FIG. 9A, the index pattern A is arranged at the uppermost and leftmost pixel group in the comparison configuration. Therefore, the input of the tone data having the tone value of the level 2 leads to a setting of the ink discharge at the upper left and lower right pixels in the uppermost and leftmost pixel group as illustrated in (A2) of FIG. 5.

Further, the index pattern D is arranged at the pixel group that is the first from the left and the second from the top. Therefore, the input of the tone data having the tone value of the level 2 leads to a setting of the ink discharge at the upper right and lower left pixels in the pixel group that is the first from the left and the second from the top as illustrated in (D2) of FIG. 5.

Further, the index pattern B is arranged at the pixel group that is the first from the left and the second from the bottom. Therefore, the input f the tone data having the tone value of the level 2 leads to a setting of the ink discharge at the upper left and lower right pixels in the pixel group that is the first from the left and the second from the bottom as illustrated in (B2) of FIG. 5.

With regard to the other pixel groups, the input of the tone data having the tone value of the level 2 to each of the pixel groups also leads to a setting of the ink discharge with use of the index pattern arranged at each of the pixel groups as illustrated in FIG. 9A and a setting of the ink discharge with respect to each of the pixels as illustrated in FIG. 9B.

Now, as understood from FIG. 9B, using the index patterns A to D illustrated in FIG. 5 and employing each of the index patterns A to D according to the arrangement pattern illustrated in FIG. 9A allows the recording data to be generated in such a manner that the pixels at which the ink discharge is set are located adjacent to each other in the Y direction when the tone data having the tone value of the threshold value "2" or smaller is input.

For example, in FIG. 9B, the ink discharge is set at a pixel that is the second from the left and the second from the top, but the ink discharge is also set at a pixel that is the second from the left and the third from the top, which is adjacent to this pixel in the Y direction. Further, the ink discharge is set at a pixel that is the first from the left and the fourth from the top, but the ink discharge is also set at a pixel that is the first from the left and the fourth from the bottom, which is adjacent to this pixel in the Y direction.

(Complementing Processing)

In the comparison configuration, processing similar to the first example embodiment is performed as the complementing processing. More specifically, when the defective discharge port has occurred, the discharge defect is complemented with use of the non-defective discharge port adjacent to this defective discharge port on the downstream side in the Y direction as described with reference to FIG. 7.

(Processing for Generating Complementary Data)

Next, the recording data and the complementary data generated when the index development processing and the complementing processing according to the above-described comparison configuration are performed will be described in detail with reference to FIGS. 10A and 10B. Pixels with circle marks written therein in FIGS. 10A and 10B each correspond to the non-defective discharge port and indicate the pixel at which the ink discharge is set by the recording data. Further, pixels with X marks written therein each correspond to the defective discharge port and indicate the pixel at which the ink discharge is set by the recording data. Further, pixels with triangle marks written therein each correspond to the non-defective discharge port and indicate the pixel at which the ink discharge is set by the complementary data.

Figure 10A:
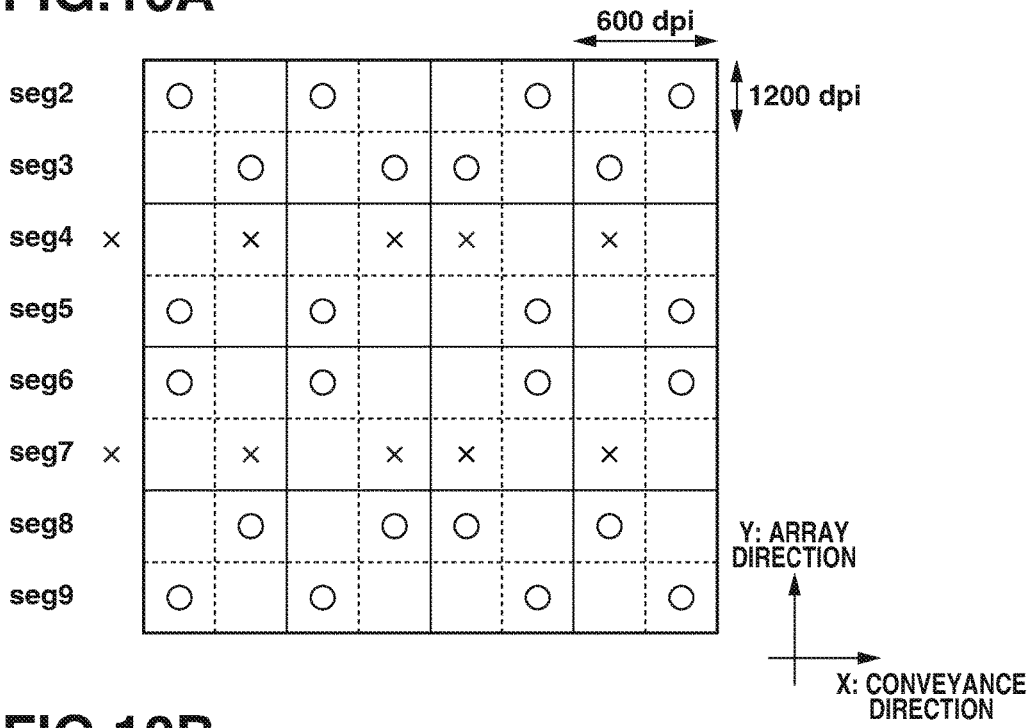
FIGS. 10A and 10B are diagrams illustrating one example of complementary data generated in the comparison configuration.

FIG. 10A illustrates pixels at which ink discharge defects occur when the recording data that sets the ink discharge at t positions like the examples illustrated in FIG. 9B is generated by the index development processing according to the comparison configuration, in the case where the defective discharge ports have occurred as illustrated in FIG. 7.

In FIG. 7, the discharge ports seg4 and seg7 are the defective discharge ports, and therefore the discharge amount of the ink undesirably falls short at the pixels corresponding to the defective discharge ports seg4 and seg7 (the pixels with the X marks written therein in FIGS. 10A and 10B) among the pixels at which the ink discharge is set by the recording data illustrated in FIG. 9B.

Figure 10B:
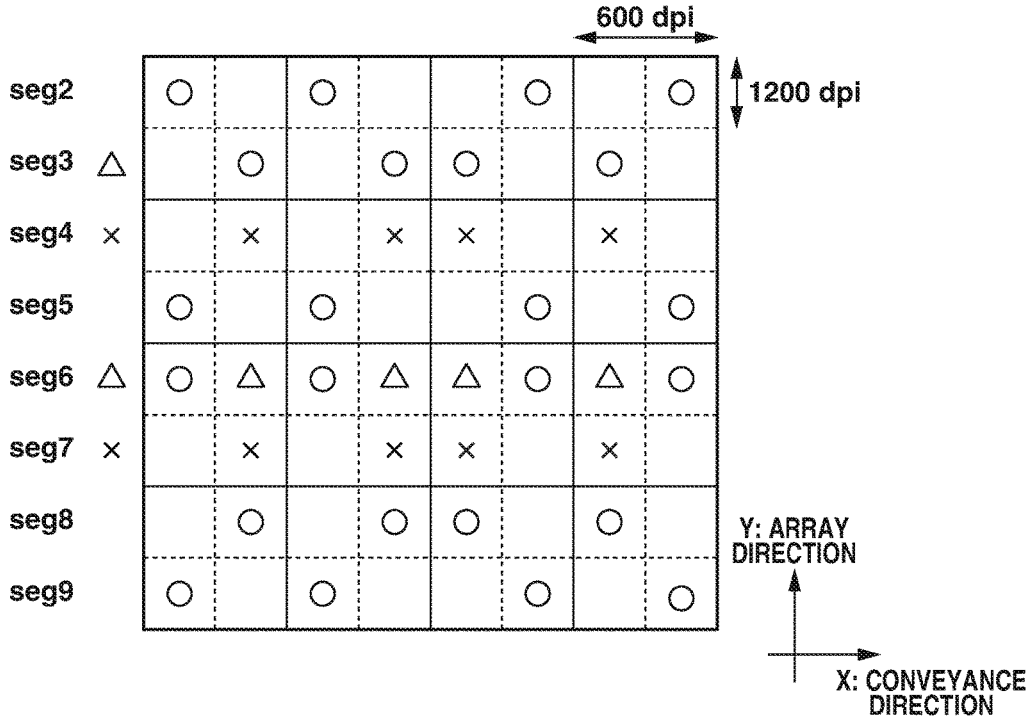

FIG. 10B illustrates the complementary data generated by performing the complementing processing according to the comparison configuration in the case illustrated in FIG. 10A.

As described above, in the comparison configuration, the discharge defect at the defective discharge port seg4 and the discharge defect at the defective discharge port seg7 are also complemented with use of the non-defective discharge port seg3 and the non-defective discharge port seg6, respectively.

Now, as illustrated in. FIG. 10A, with respect to the pixels at which the ink discharge from the defective discharge port seg7 is set by the recording data (the pixels with the X marks written therein), the ink discharge is not set at the pixels adjacent thereto on the downstream side in the Y direction by the recording data. Therefore, as illustrated in FIG. 10B, the recording apparatus generates the complementary data so as to discharge the ink at the pixels (the pixels with the triangle marks written therein) adjacent on the downstream side in the Y direction to the pixels that should have been recorded by the defective discharge port seg7 (the pixels with the X marks written therein) with use of the non-defective discharge port seg6 adjacent to the defective discharge port seg7 on the downstream side in the Y direction, thereby complementing the discharge defect at the defective discharge port seg7.

However, as illustrated in FIG. 10A, with respect to the pixels at which the ink discharge from the defective discharge port seg4 is set by the recording data (the pixels with the X marks written therein), the ink discharge is already set with respect to the pixels adjacent to these pixels on the downstream side in the Y direction by the recording data. This means that the ink is discharged from the non-defective discharge port seg3 with respect to these adjacent pixels according to the recording data, so that the ink cannot be discharged for complementing the discharge defect at the defective discharge port seg4. Therefore, employing this configuration makes it impossible to complement the discharge defect at the defective discharge port seg4 as illustrated in FIG. 10B.

In this manner, according to the comparison configuration, the recording apparatus becomes unable to, with respect to a part of the pixels corresponding to the defective discharge ports and set to be subjected to the ink discharge by the recording data, complement the discharge defect with use of the pixels adjacent to these pixels in the Y direction.

In the above-described first example embodiment, the recording apparatus has been described as being configured to perform the index development processing so as to prohibit the pixels at which the ink discharge is set from being located adjacent to each other in the Y direction in the predetermined region, and perform the complementing processing so as to complement the discharge defect with use of the non-defective discharge port adjacent to the defective discharge port on the downstream side in the Y direction.

On the other hand, in a second example embodiment, the recording apparatus performs the index development processing while allowing the pixels at which the ink discharge is set to be located adjacent to each other in the Y direction in a part of the predetermined region. Then, the recording apparatus changes which is used to complement the discharge defect, the non-defective discharge port adjacent to the defective discharge port on an upstream side in the Y direction, or the non-defective discharge port adjacent to the defective discharge port on the downstream side in the Y direction, according to the position of the defective discharge port.

The second example embodiment will be described omitting descriptions of similar features to the above-described first example embodiment.

(Index Development Processing)

A detail of the index development processing performed in the present example embodiment will be described.

In the present example embodiment, index patterns E to H are further used in addition to the index patterns A to D illustrated in FIG. 5. This means that, in the present example embodiment, the recording apparatus has eight types of index patterns, and selects and employs these index patterns according to the position on the recording medium to which the pixel group corresponds.

Figure 11:
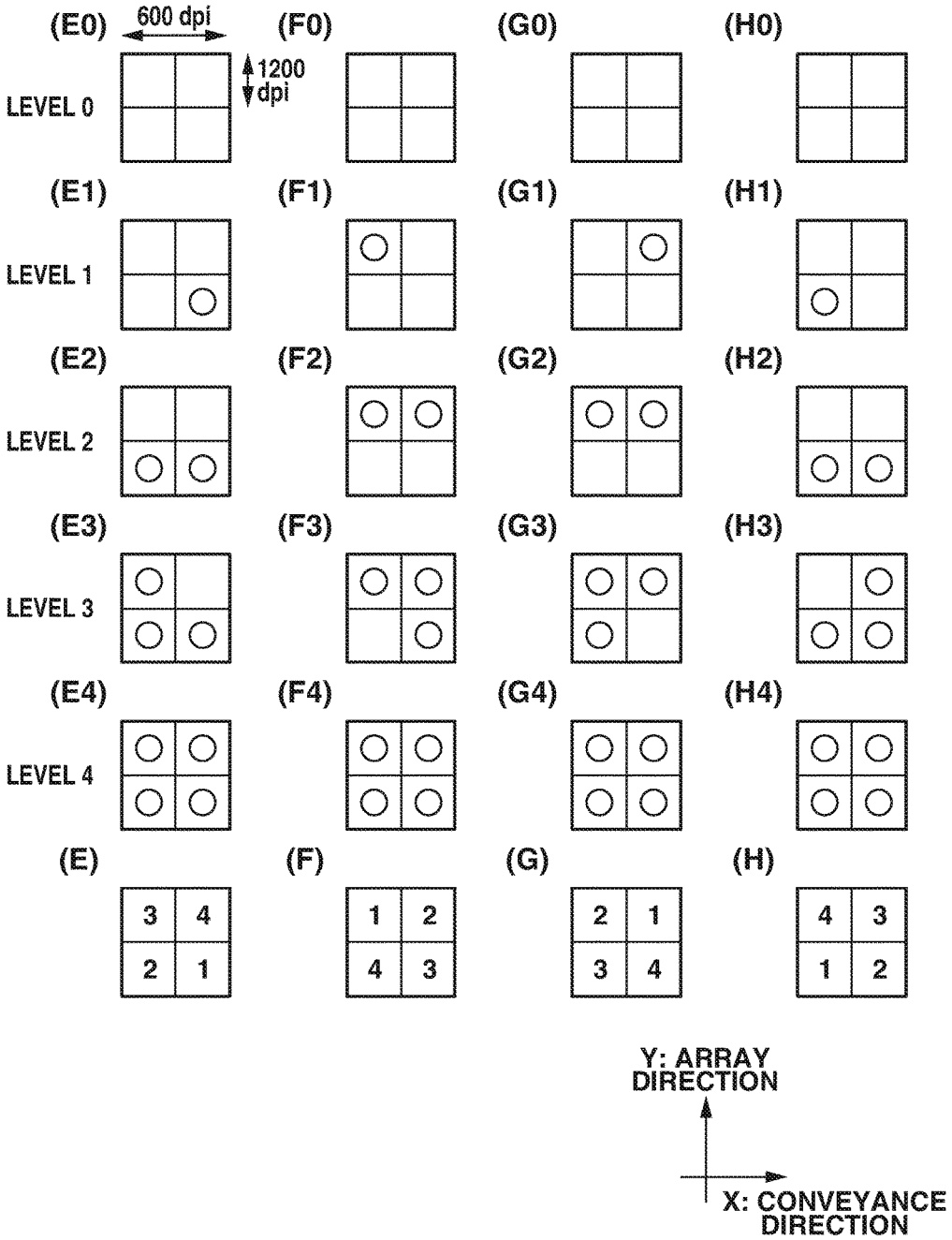
FIG. 11 is a schematic diagram illustrating index patterns according to an example embodiment.

FIG. 11 schematically illustrates the index patterns used in the present example embodiment.

FIG. 11 illustrates the index patterns E to used in the present example embodiment in (E) to (H) thereof. Similarly to FIG. 5, a number in each of the pixels indicates the threshold value for determining whether or not to discharge the ink compared to the tone value the tone data. More specifically, if the tone value matches or exceeds the threshold value in each of the pixels, the ink discharge is set with respect to this pixel, and, if the tone value is smaller than the threshold value, the inexecution of the ink discharge is set with respect to this pixel.

For example, in the index pattern E illustrated in (E) of FIG. 11, threshold values "1", "2", "3", and "4" are set for the lower right pixel, the lower left pixel, the upper left pixel, and the upper right pixel, respectively. Therefore, if the index pattern illustrated in (E) of FIG. 11 is used, the inexecution of the ink discharge is set at all of the pixels for the level 0 ((E0) of FIG. 11). Then, the ink discharge is set at only the lower right pixel for the level 1 ((E1) of FIG. 11), at the lower right and lower left pixels for the level ((E2) of FIG. 11), and at the lower right, lower left, and upper left pixels for the level 3 ((E3) of FIG. 11). Then, the ink discharge is set at all of the pixels for the level 4 ((E4) of FIG. 11).

The same also applies to the index pattern F, the index pattern G, and the index pattern H respectively illustrated in (F), (G), and (H) of FIG. 11.

If the index pattern F is used, the inexecution of the ink discharge is set at all of the pixels for the level 0 ((F0) of FIG. 11). Then, the ink discharge is set at only the upper left pixel for the level 1 ((F1) of FIG. 11), at the upper left and upper right pixels for the level ((F2) of FIG. 11), and at the upper left, upper right, and lower right pixels for the level 3 ((F3) of FIG. 11). Then, the ink discharge is set at all of the pixels for the level 4 ((F4) of FIG. 11).

Further, if the index pattern G is used, the inexecution of the ink discharge is set at all of the pixels for the level 0 ((GO) of FIG. 11). Then, the ink discharge is set at only the upper right pixel for the level 1 ((G1) of FIG. 11), at the upper right and upper left pixels for the level 2 ((G2) of FIG. 11), and at the upper right, upper left, and lower left pixels for the level 3 ((G3) of FIG. 11). Then, the ink discharge is set at all of the pixels for the level 4 ((G4) of FIG. 11).

Further, if the index pattern H is used, the inexecution of the ink discharge is set at all of the pixels for the level 0 ((HO) of FIG. 11). Then, the ink discharge is set at only the lower left pixel for the level ((H1) of FIG. 11), at the lower left and lower right pixels for the level 2 ((H2) of FIG. 11), and at the lower Left, lower right, and upper right pixels for the level 3 ((H3) of FIG. 11). Then, the ink discharge is set at all of the pixels for the level 4 ((H4) of FIG. 11).

Then, as understood from FIG. 11, the index patterns E to H are also set in such a manner that any of the pixels for which the threshold values "1" and "2" are set are not located adjacent to each other in the Y direction within the same index pattern, similarly to the index patterns A to D.

In the present example embodiment, the index patterns A to D illustrated in FIG. 5 and the index patterns E to H illustrated in FIG. 11 are arranged according to a predetermined arrangement pattern, and the index development is carried out on the tone data according to each of the arranged index patterns, by which the recording data is generated.

In the present example embodiment, the index patterns A to H are arranged while allowing the pixels at which the ink discharge is set to be located adjacent to each other if different index patterns are allocated to these pixels when the tone data having the tone value of the threshold value "2" or smaller is input.

Figure 12A:
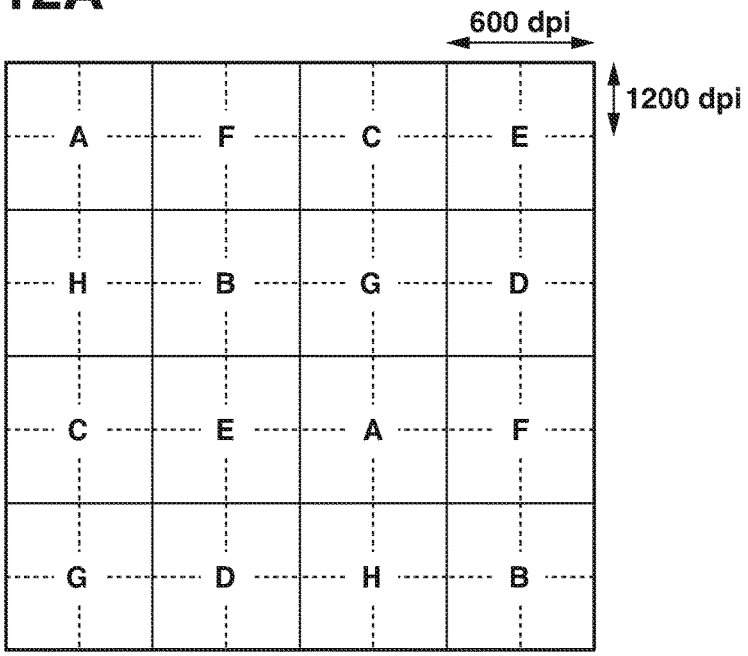
FIGS. 12A and 12B are diagrams illustrating one example of recording data generated in the example embodiment.
Figure 12B:
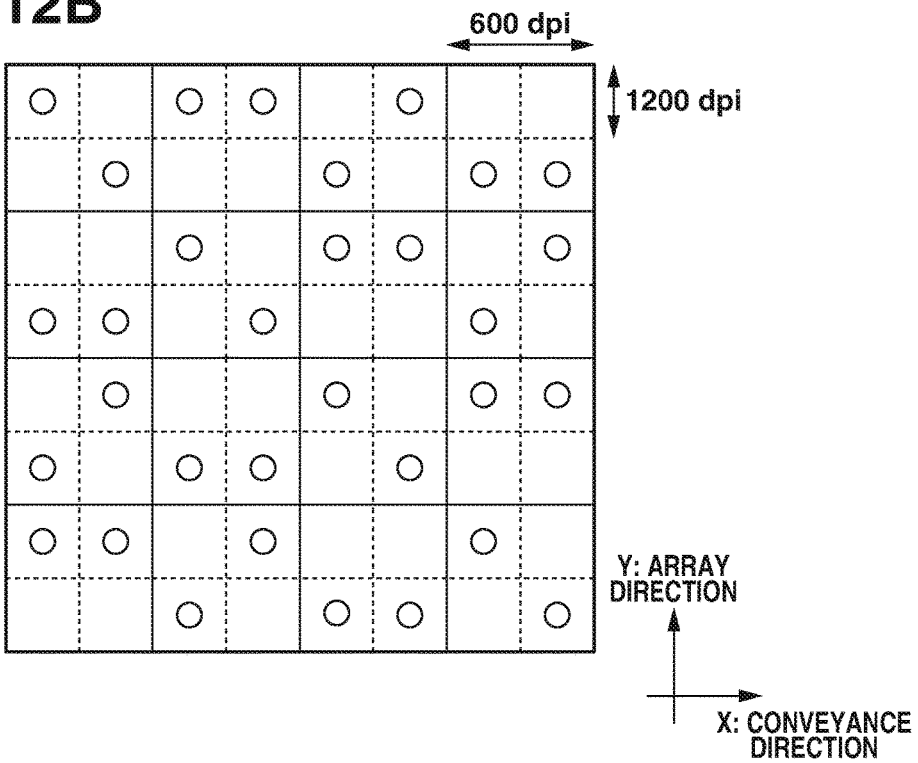

FIG. 12A illustrates the arrangement pattern of the index patterns A to H according to the present example embodiment. Further, FIG. 12B schematically illustrates the recording data generated when the tone data having the tone value of the level 2 is input to each of the pixel groups, in the case where the index patterns A to H are arranged according to the arrangement pattern illustrated in FIG. 12A. Each of pixels with circle marks written therein and each of pixels without anything written therein in FIG. 12B indicate the pixel at which the ink discharge is set and the pixel at which the inexecution of the ink discharge is set, respectively. FIGS. 12A and 12B illustrate processing on the region of 8 pixels×8 pixels (the predetermined region) on the recording medium for simplicity.

For example, as illustrated in FIG. 12A, the index pattern A is arranged at the uppermost and leftmost pixel group in the present example embodiment. Therefore, the input of the tone data having the tone value of the level 2 leads to a setting of the ink discharge at the upper left and lower right pixels in the uppermost and leftmost pixel group as illustrated in (A2) of FIG. 5.

Further, the index pattern H is arranged at the pixel group that is the first from the left and the second from the top. Therefore, the input of the tone data having the tone value of the level 2 leads to a setting of the ink discharge at the lower left and lower right pixels in the pixel group that is the first from the left and the second from the top as illustrated in (H2) of FIG. 11.

Further, the index pattern C is arranged at the pixel group that is the first from the left and the second from the bottom. Therefore, the input of the tone data having the tone value of the level 2 leads to a setting of the ink discharge at the upper right and lower left pixels in the pixel group that is the first from the left and the second from the bottom as illustrated in (C2) of FIG. 5.

With regard to the other pixel groups, the input of the tone data having the tone value of the level 2 to each of the pixel groups also leads to a setting of the ink discharge with use of the index pattern arranged at each the pixel groups as illustrated in FIG. 12A and a setting of the ink discharge with respect to each of the pixels as illustrated in FIG. 12B.

In the present example embodiment, as described above, the recording apparatus uses the index patterns A to D illustrated in FIG. 5 and the index patterns to H illustrated in FIG. 11, and employs each of the index patterns A to H according to the arrangement pattern illustrated in FIG. 12A. This configuration allows the recording data to be generated in such a manner that a part of the pixels at which the ink discharge is set is located adjacent to each other in the Y direction if the different index patterns correspond to these pixels as illustrated in FIG. 12B, when the tone data having the tone value of the threshold value "2" or smaller is input.

For example, a pixel that is the second from the left and the fourth from the top and a pixel that is the second from the left and the fourth from the bottom in FIG. 12B are adjacent to each other in the Y direction, but the former pixel and the latter pixel correspond to the index pattern H and the index pattern C as illustrated in FIG. 12A, respectively. Then, as illustrated in FIG. 12B, the ink discharge is set with respect to both of these two pixels by the recording data.

Further, for example, a pixel that is the fourth from the left and the third from the bottom and a pixel that is the fourth from the left and the second from the bottom in FIG. 12B are adjacent to each other in the Y direction, but the former pixel and the latter pixel correspond to the index pattern F and the index pattern D as illustrated in FIG. 12A, respectively. Then, as illustrated in FIG. 12B, the ink discharge is set with respect to both of these two pixels by the recording data.

(Complementing Processing)

The complementing processing performed in the present example embodiment will be described in detail.

Figure 13:
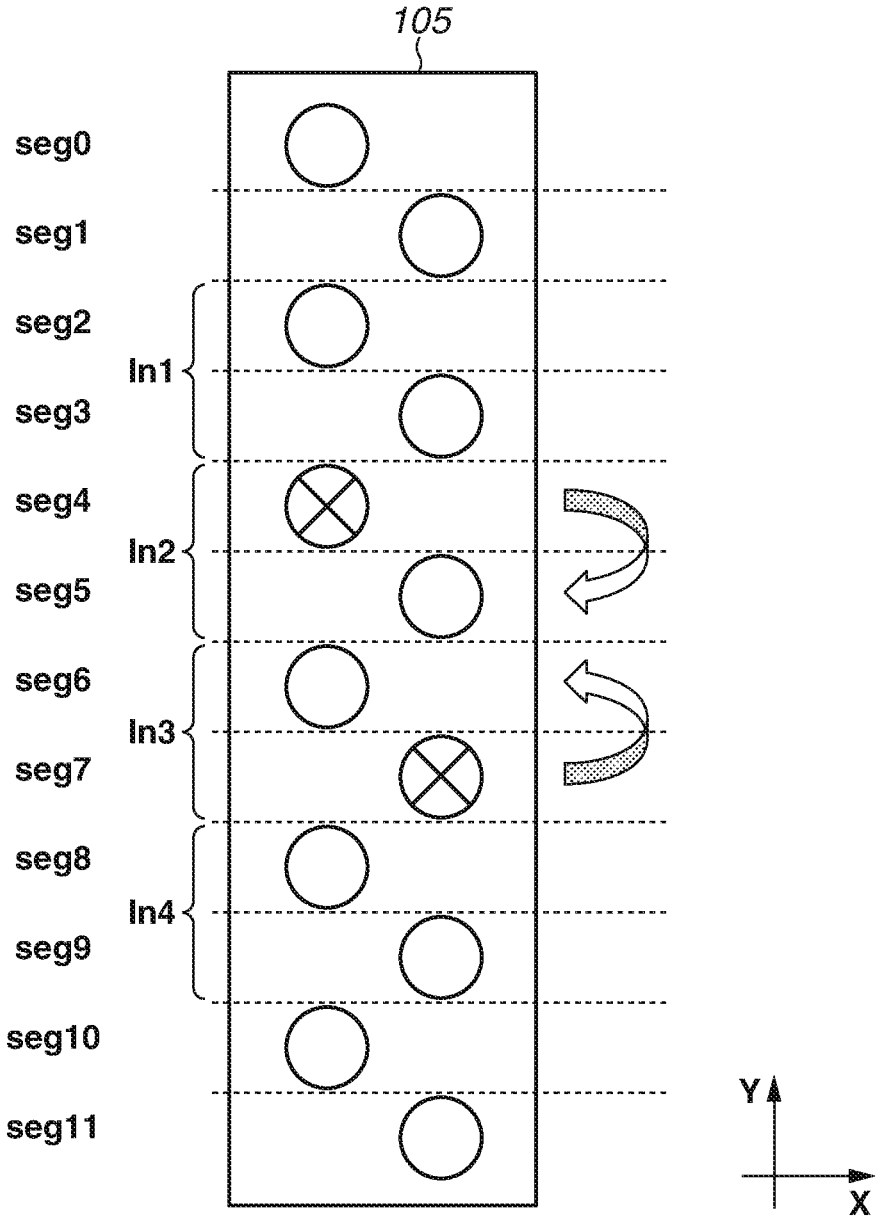
FIG. 13 is a schematic diagram illustrating complementing processing according to the example embodiment.

FIG. 13 is a schematic diagram illustrating the complementing processing according to the present example embodiment. In the present example, the complementing processing will be described assuming that the discharge ports seg4 and seg7 among the discharge ports seg0 to seg11 are the defective discharge ports.

In the present example embodiment, the complementing processing will be described assuming that a correspondence between the discharge ports and the arrangement pattern of the index patterns are such that the discharge port seg2 and an upper end of the arrangement pattern correspond to each other. More specifically, a region In1 at the upper end in the arrangement pattern illustrated in FIG. 12A corresponds to the discharge ports seg2 and seg3. The region In1 is a region in which the index patterns A, F, C, and E are arranged in this order from the left. Further, a region In2 (a region in which the index patterns H, B, G, and D are arranged in this order from the left), which is the second from the upper end in the arrangement pattern illustrated in FIG. 12A, corresponds to the discharge ports seg4 and seg5. Further, a region In3 (a region in which the index patterns C, E, A, and F are arranged in this order from the left), which is the second from a lower end in the arrangement pattern illustrated in FIG. 12A, corresponds to the discharge ports seg6 and seg7. Further, a region In4 (a region in which the index patterns G, D, H, and B are arranged in this order from the left) at the lower end in the arrangement pattern illustrated in FIG. 12A corresponds to the discharge ports seg8 and seg9.

Then, in the present example embodiment, when the discharge defect has occurred at some discharge port, the non-defective discharge port corresponding to the same index pattern as the defective discharge port is selected from the non-defective discharge port adjacent to the defective discharge port on the upstream side in the Y direction and the non-defective discharge port adjacent to the defective discharge port an the downstream side in the Y direction as the discharge port to be used to compensate the discharge defect.

For example, the defective discharge port seg4 corresponds to the region In2 (the region in which the index patterns H, B, G, and D are arranged in this order from the left) in the arrangement pattern, so that the non-defective discharge port seg5 corresponding to the same region In2 is selected from the non-defective discharge ports seg3 and seg5 adjacent to the discharge port seg4 in the Y direction as the discharge port for complementing the discharge defect at the defective discharge port seg4. Further, the defective discharge port seg7 corresponds to the region In3 (the region in which the index patterns C, E, A, and F are arranged in this order from the left) in the arrangement pattern, and therefore the non-defective discharge port seg6 corresponding to the same region In3 is selected from the non-defective discharge ports seg6 and seg8 adjacent to the discharge port seg7 in the Y direction as the discharge port for complementing the discharge defect at the defective discharge port seg7. Then, the complementary data is generated in such a manner that the ink discharge is set at these non-defective discharge ports seg5 and seg6 to be used to complement the discharge defects.

(Processing for Generating Complementary Data)

Next, the complementary data generated when the index development processing and the complementing processing according to the above-described present example embodiment are performed will be described in detail with reference to FIGS. 14A and 14B. Pixels with circle marks written therein in FIGS. 14A and 14B each correspond to the non-defective discharge port and indicate the pixel at which the ink discharge is set by the recording data. Further, pixels with X marks written therein each correspond to the defective discharge port and indicate the pixel at which the ink discharge is set by the recording data. Further, pixels with triangle marks written therein each correspond to the non-defective discharge port and indicate the pixel at which the ink discharge is set by the complementary data.

Figure 14A:
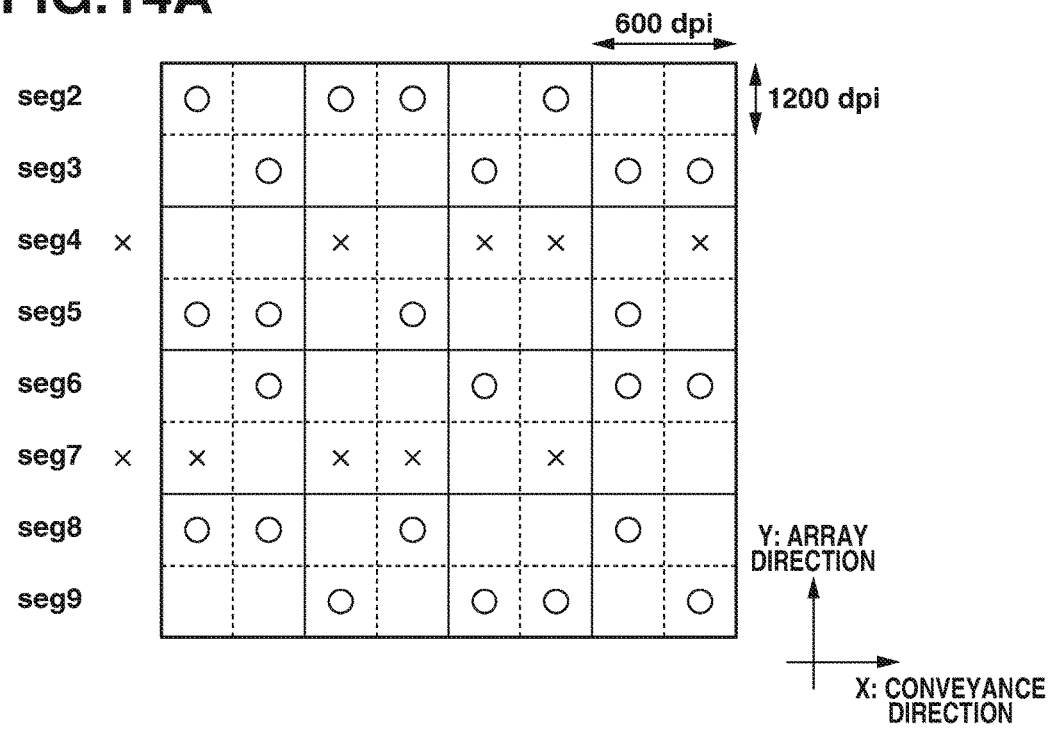
FIGS. 14A and 14B are diagrams illustrating one example of complementary data generated in the example embodiment.

FIG. 14A illustrates pixels at which ink discharge defects occur when the recording data that sets the ink discharge at the positions like the examples illustrated in FIG. 12B is generated by the index development processing according to the present example embodiment, in the case where the defective discharge ports have occurred as illustrated in FIG. 13.

In FIG. 13, the discharge ports seg4 and seg7 are the defective discharge ports, and therefore the discharge amount of the ink undesirably falls short at the pixels corresponding to the defective discharge ports seg4 and seg7 (the pixels with the X marks written therein in FIGS. 14A and 14B) among the pixels at which the ink discharge is set by the recording data illustrated in FIG. 12B.

Figure 14B:
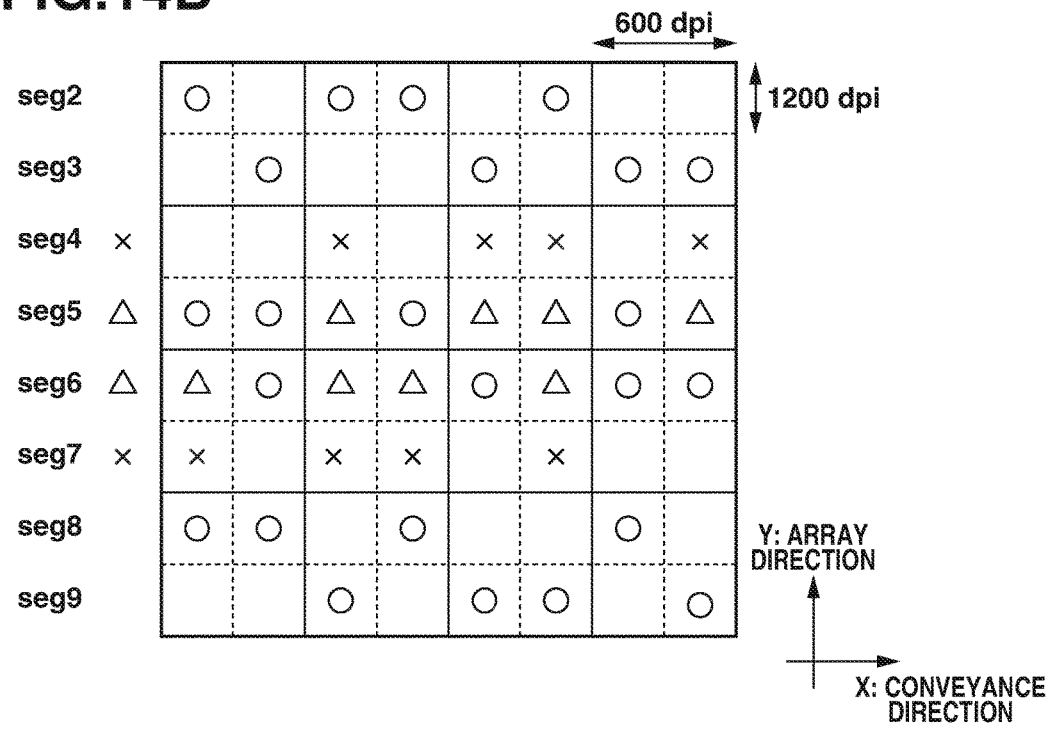

FIG. 14B illustrates the complementary data generated by performing the complementing processing according to the present example embodiment in the case illustrated in FIG. 14A.

As described above, in the present example embodiment, the discharge defect at the defective discharge port seg4 and the discharge defect at the defective discharge port seg7 are complemented with use of the non-defective discharge port seg5 and the non-defective discharge port seg6, respectively.

In the present example embodiment, the pixels at which the ink is discharged can be located adjacent to each other in the Y direction if the regions thereof correspond to the different index patterns (the different pixel groups) as described above. However, in the complementing processing according to the present example embodiment, the processing for complementing the discharge defect is performed with use of the non-defective discharge port adjacent to the defective discharge port in the Y direction and corresponding to the same index pattern (the same pixel group) as the defective discharge port. Therefore, even when the ink discharge is set at the non-defective discharge port corresponding to the different index pattern from the defective discharge port by the recording data, this non-defective discharge port is not used to complement the discharge defect. Then, if the tone value is the level or lower, the index patterns A to H do not cause the pixels at which the ink discharge is set to be located adjacent to each other, and therefore do not set the ink discharge at the positions adjacent to each other in the Y direction from the two discharge ports corresponding to the same index pattern.

Therefore, as illustrated in FIG. 14B, according to the present example embodiment, the recording data can be generated in such a manner that the ink is not discharged with respect to the pixels adjacent on the upstream side in the Y direction to the pixels at which the ink discharge from the defective discharge port seg4 is set by the recording data (the pixels with t X marks written therein). Further, the recording data can be generated in such a manner that the ink is not discharged with respect to the pixels adjacent on the downstream side in the Y direction to the pixels at which the ink discharge from the defective discharge port seg7 is set by the recording data (the pixels with the X marks written therein).

Therefore, the complementary data can be generated in such a manner that the ink is discharged from the non-defective discharge ports seg5 and seg6 adjacent to the defective discharge ports seg4 and seg7 in the Y direction with respect to both the pixels adjacent in the Y direction to the pixels at which the ink discharge from the defective discharge ports seg4 and seg7 is set. This means that, as illustrated in FIG. 14B, the complementing processing according to the present example embodiment results in generation of the complementary data in such a manner that, with respect to all of the pixels at which the ink discharge from the defective discharge ports is set (the pixels with the X marks written therein in FIG. 14B), the ink is discharged with respect to the pixels adjacent to these pixels in the Y direction (the pixels with the triangle marks written therein FIG. 14B).

In the above-described manner, according to the present example embodiment, the recording apparatus also becomes able to, with respect to all of the pixels corresponding to the defective discharge ports and set to be subjected to the ink discharge by the recording data, conduct the complementary discharge with respect to the pixels adjacent to these pixels in the Y direction. As a result, the recording apparatus can effectively prevent or reduce the deterioration of the image quality due to the discharge defect.

In each of the above-described example embodiments, the recording apparatus has been described as being configured to complement the discharge defect by always using the non-defective discharge port adjacent to the defective discharge port on the same side regardless of a page and a job to be recorded when the defective discharge port has occurred, but the present disclosure can also be implemented by another configuration.

For example, in the first example embodiment, the discharge defects at the defective discharge ports seg4 and seg7 are complemented with use of the non-defective discharge ports seg3 and seg6 adjacent to the defective discharge ports seg4 and seg7 on the downstream side in the Y direction, but the recording apparatus may be configured to complement the discharge defects with use of the non-defective discharge ports seg5 and seg8 adjacent to the defective discharge ports on the upstream side the direction. Further, the recording apparatus may be configured to change a mode of complementing the discharge defects with use of the non-defective discharge ports seg3 and seg6 and a mode of complementing the discharge defects with use of the non-defective discharge ports seg5 and seg8 at a timing when the page or the job to be recorded is switched. Further, for example, in the first example embodiment, the defective discharge port seg4 is complemented with use of the discharge port seg3 adjacent to the defective discharge port seg4 on the downstream side in the Y direction, but the complementing source may be selectively switched in such a manner that some pixel is complemented with use of the discharge port seg3 and another pixel is complemented with use of the discharge port seg5 depending on the pixel even within the same mode.

Further, for example, in the second example embodiment, the discharge defect at the defective discharge port seg4 and the discharge defect at the defective discharge port seg7 are complemented with use of the non-defective discharge port seg5 adjacent to the defective discharge port seg4 on the upstream side in the Y direction and the non-defective discharge port seg6 adjacent to the defective discharge port seg7 on the downstream side in the Y direction, respectively, but the defective discharge port seg4 and the defective discharge port seg7 may be complemented with use of the non-defective discharge port seg3 and the non-defective discharge port seg8, respectively. However, in the case where the discharge defects are complemented with use f the non-defective discharge ports seg3 and seg8, the correspondence between the discharge ports and the arrangement pattern of the index patterns needs to be shifted in the Y direction relative to a case where the discharge defects are complemented with use of the non-defective discharge ports seg5 and seg6. This is because a failure to shift the correspondence may cause the pixels at which the ink discharge is set by the recording data to be located adjacent to each other in the Y direction since the defective discharge port seg4 and the non-defective discharge port seg3 correspond to the different regions In1 and In2 in the arrangement pattern. For example, if the correspondence between the discharge ports and the arrangement pattern is shifted so as to establish such a relationship that the discharge port seg1 and the upper end in the arrangement pattern correspond to each other, this shift leads to the defective discharge port seg4 and the non-defective discharge port seg3 corresponding to the same region In2, thereby succeeding in acquiring similar effects to the second example embodiment. The recording apparatus may be configured to change the mode of complementing the discharge defects with use of the non-defective discharge ports seg5 and seg6 that has been described in the second example embodiment and the above-described mode of complementing the discharge defects with use of the non-defective discharge ports seg3 and seg8 at the timing when the page or the job to be recorded is switched.

Further, in the first example embodiment, the recording apparatus has been described as being configured to perform the index development processing so as to prohibit the pixels at which the ink discharge is set from being located adjacent to each other in the Y direction with respect to all of the pixels in the region of 8 pixels×8 pixels when the tone data having the tone value of the level 2 is input as illustrated in FIG. 6B, but, to some extent, the pixels at which the ink discharge is set may be located adjacent to each other in the Y direction. The deterioration of the image quality due to the discharge defect can be prevented or reduced to some degree as long as more than half of the pixels at which the ink discharge is set in the predetermined region are not located adjacent to another pixel at which the ink discharge is set. However, needless to say, it is most desirable that the pixels at which the ink discharge is set are not located adjacent to each other in the Y direction with respect to all of the pixels in the predetermined region as illustrated in FIG. 6B.

Further, in the second example embodiment, the recording apparatus has been described as being configured to perform the index development processing so as to prohibit the pixels at which the ink discharge is set from being located adjacent to each other in the Y direction with respect to all of the pixels from the perspective of each of the pixel groups of 2 pixels×2 pixels to which the same index pattern corresponds in the region of 8 pixels×8 pixels, when the tone data having the tone value of the level 2 is input as illustrated in FIG. 12B. It is desirable that the discharge defect can be complemented at all of the pixels in the region, like this configuration, in terms of the complementing processing. However, to some extent, the pixels at which the ink discharge is set may be located adjacent to each other in the Y direction in the pixel group of 2 pixels×2 pixels to which the same index pattern corresponds. As far as this configuration is concerned, the deterioration of the image quality due to the discharge defect can be prevented or reduced to some degree as long as the pixels at which the discharge defects cannot be complemented because the ink discharge is already set at the complementing source pixels therefor, among the pixels at which the ink discharge is set in the predetermined region of 8 pixels×8 pixels, are less than half.

Further, in each of the example embodiments, the recording apparatus has been described referring to the example in which the tone data having the tone value of the level 2 is input, but similar effects can be acquired by employing the configuration according to each of the example embodiments even when the tone data having the tone value of the level 1 is input. The effects achieved by each of the example embodiments can be acquired when tone data having a tone value of a low level is input. Especially, noticeable effects can be acquired when the input tone data indicates a tone value (the level 2 in each of the example embodiments) approximately half as large as a maximum value (the level 4 in each of the example embodiments) among the tone values indicatable by the tone data. Therefore, it is desirable that the index pattern used in the present example embodiments is set in such a manner that pixels for which the threshold value is set to approximately the half of the maximum value among the tone values indicatable by the tone data are not located adjacent to each other in the Y direction within the same index pattern.

Further, in each of the example embodiments, the recording apparatus has been described as being configured to discharge the ink while moving the recording medium P relative to the fixed recording heads 105 to 108, but may be configured to discharge the ink while moving the recording head relative to a stationary recording medium (in the X direction illustrated in FIG. 1).

Further, each of the example embodiments has been described with respect to the recording apparatus and the recording method using the recording apparatus, but the present disclosure can also be applied to an image processing apparatus or an image processing method that generates data for realizing the recording method described in each of the example embodiments. Further, the present disclosure can also be applied to a configuration in which a program for realizing the recording method described in each of the example embodiments is prepared in a different apparatus from the recording apparatus.

According to the recording apparatus of the present disclosure, the recording apparatus becomes able to complement the discharge defect with use of the discharge port adjacent to the defective discharge port without excessively reducing the throughput.

While the present disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2017-089517, filed Apr. 28, 2017, which is hereby incorporated by reference herein in its entirety.

What is claimed is:

1. A recording apparatus comprising:

a recording head including a plurality of ink discharge ports arranged in a predetermined direction;

a determination unit configured to, according to tone data indicating a tone of an image to be formed on a recording medium, determine recording data indicating whether or not to discharge ink at a position corresponding to each of pixels forming the image on the recording medium;

a complementing unit configured to generate complementary data based on the recording data, according to discharge defect information identifying a defective discharge port at which a discharge defect has occurred among the plurality of ink discharge ports, for causing a different discharge port, from the identified defective discharge port for discharging the ink to a different position from a position corresponding to the defective discharge port, to discharge ink; and a control unit configured to control a recording operation so as to move the recording head and the recording medium relative to each other in a direction intersecting the predetermined direction and discharge ink from the recording head onto the recording medium according to the complementary data, wherein, if at least one discharge port among the plurality of ink discharge ports is identified as the defective discharge port, the complementing unit generates the complementary data for causing a discharge port, configured to discharge at a complementing position that is one predetermined position of positions adjacent, on both side in the predetermined direction, to a position at which the at least one discharge port discharge the ink, to discharge ink, and wherein, if a tone value indicated by the tone data indicates a tone value half as large as a maximum tone value, the determination unit determines not to discharge the ink at more than half of complementing positions, each of which is the complementing position for the at least one discharge port.

2. The recording apparatus according to claim 1, wherein the complementing unit causes the discharge port at the position on the one side that is the one of the positions adjacent to the defective discharge port in the predetermined direction to discharge the complementary data to a position at which the defective discharge port should discharge the ink.

3. The recording apparatus according to claim 1, wherein, with respect to each of the plurality of ink discharge ports, if this discharge port is identified as the defective discharge port, the complementing unit sets the discharge port configured to discharge the ink at the position on the one side that is the one of the positions adjacent in the predetermined direction to the position at which the at least one discharge port discharges the ink, as the different discharge port.

4. The recording apparatus according to claim 1, wherein, if the tone value indicated by the tone data indicates the tone value half as large as the maximum tone value, the determination unit determines not to discharge the ink at more than half of the complementing positions, each of which is the complementing position for each of the discharge ports.

5. The recording apparatus according to claim 1, wherein, if the tone value indicated by the tone data indicates the tone value half as large as the maximum tone value, the determination unit determines not to discharge the ink at all of the complementing positions.

6. The recording apparatus according to claim 5, wherein, if the tone value indicated by the tone data indicates the tone value half as large as the maximum tone value, the determination unit determines not to discharge the ink at all of the positions adjacent in the predetermined direction to the position at which the defective discharge port should have discharged the ink originally when this discharge port is identified as the defective discharge port.

7. The recording apparatus according to claim 2, wherein the complementing position for the discharge port identified as the defective discharge port is a position at which the ink is discharged by a discharge port adjacent on the same side that is one of the discharge ports adjacent to the defective discharge port in the predetermined direction.

8. The recording apparatus according to claim 7, wherein the complementing position for each of the plurality of ink discharge ports is a position adjacent on the same one side that is one of the positions adjacent in the predetermined direction to the position at which the defective discharge port should have discharged the ink originally when this discharge port is identified as the defective discharge port.

9. The recording apparatus according to claim 1, wherein the determination unit determines whether or not to discharge the ink at the corresponding position for each of the pixels by using, according to the tone value allocated to a pixel group, an index pattern defining the number of pixel(s) and a position of a pixel at which the discharge of the ink is set in this pixel group, and employing the index pattern individually with respect to each of the pixels.

10. The recording apparatus according to claim 9, wherein the discharge of the ink is not set at more than half of the complementing positions in the index pattern.

11. The recording apparatus according to claim 1, wherein the complementing unit determines to use a position adjacent on a first side in the predetermined direction to the position at which the ink should be discharged by the defective discharge port as the position at which the discharge of ink is caused to be conducted until a predetermined timing, and determines to use a position adjacent on a second side opposite from the first side in the predetermined direction to the position at which the ink should be discharged by the defective discharge port as the position at which the discharge of ink is caused to be conducted after the predetermined timing.

12. A recording apparatus comprising:

a recording head including plurality of ink discharge ports arranged in a predetermined direction;

a determination unit configured to, according to tone data indicating a tone of an image to be formed on a recording medium, determine recording data indicating whether or not to discharge ink at a position corresponding to each of pixels forming the image on the recording medium;

a complementing unit configured to generate complementary data for based on the recording data for causing a complementary discharge port to discharge ink based on discharge defect information identifying a defective discharge port at which a discharge defect has occurred among the plurality of discharge ports; and a control unit configured to control a recording operation so as to move the recording head and the recording medium relative to each other in a direction intersecting the predetermined direction and discharge the ink from the recording head onto the recording medium according to the complementary data, wherein, if at least one discharge port among the plurality of ink discharge ports is identified as the defective discharge port, the complementing unit determines to use a discharge port that is one of predetermined discharge ports adjacent to the at least one discharge port on both side in the predetermined direction as the complementary discharge port, and wherein, if a tone value indicated by the tone data indicates a tone value half as large as a maximum tone value, the determination unit determines not to discharge the ink at more than half positions each adjacent in the predetermined direction to a position at which the ink should be discharged by the at least one discharge port and possible to be subjected to the discharge of ink by the complementary discharge port.

13. A recording apparatus comprising:

a recording head including plurality of ink discharge ports arranged in a predetermined direction;

a determination unit configured to, according to tone data indicating a tone of an image to be formed on a recording medium, determine whether or not to discharge ink at a position corresponding to each of pixels forming the image on the recording medium; and a complementing unit configured to, based on the recording data and discharge defect information identifying a defective discharge port at which a discharge defect has occurred among the plurality of discharge ports, determine to conduct discharge of complementary ink for complementing the ink that should have been discharged by the defective discharge port with use of a discharge port adjacent to the identified defective discharge port in the predetermined direction; and a control unit configured to control a recording operation so as to move the recording head and the recording medium relative to each other in a direction intersecting the predetermined direction and discharge the ink from the recording head onto the recording medium according to the determination made by the determination unit and the determination made by the complementing unit, wherein, it some discharge port is identified as the defective discharge port, the complementing unit determines to conduct the discharge of the complementary ink for complementing the ink that should have been discharged by the defective discharge port with use of the discharge port adjacent to the defective discharge port in the predetermined direction based on complementing source information indicating one predetermined discharge port of discharge ports on both side adjacent to the identified defective discharge port in the predetermined direction as a complementing source discharge port, and wherein, if a tone value indicated by the tone data indicates a tone value half as large as a maximum tone value, it is determined to discharge ink onto the recording medium at positions as the complementary ink at more than half of positions for which the discharge of the complementary ink has been determined.

14. A recording method for carrying out recording with use of a recording head including a plurality of ink discharge ports arranged in a predetermined direction, the recording method comprising:

determining recording data, according to tone data indicating a tone of an image to be formed on a recording medium, indicating whether or not to discharge ink at a position corresponding to each of pixels forming the image on the recording medium;

generating complementary data based on recording data, according to discharge defect information identifying a defective discharge port at which the discharge defect has occurred among the plurality of ink discharge ports, for causing a different discharge port, from the identified defective discharge port for discharging the ink at a different position from a position corresponding to the defective discharge port, to discharge ink; and discharging ink from the recording head onto the recording medium according to the complementary data while moving the recording head and the recording medium relative to each other in a direction intersecting the predetermined direction, wherein, in the generating, if at least one discharge port among the plurality of ink discharge ports is identified as the defective discharge port, the complementary data for causing a discharge port, configured to discharge the ink at a complementing position that is one predetermined position of positions adjacent, on both side in the predetermined direction, to a position at which the at least one discharge port discharges the ink, to discharge ink, and wherein, in the determining, if a tone value indicated by the tone data indicates a tone value half as large as a maximum tone value, the ink is determined not to be discharged at more than half of complementing positions, each of which is the complementing position for the at least one discharge port.

15. A recording apparatus comprising:

a recording head including a plurality of ink discharge ports arranged in a predetermined direction;

a determination unit configured to, according to tone data indicating a tone of an image to be formed on a recording medium, determine recording data indicating whether or not to discharge ink at a position corresponding to each of pixels forming the image on the recording medium;

a complementing unit configured to generate complementary data based on the recording data, according to discharge defect information identifying a defective discharge port at which a discharge defect has occurred among the plurality of ink discharge ports, for causing a different discharge port, from the identified defective discharge port for discharging the ink to a different position from a position corresponding to the defective discharge port, to discharge ink; and a control unit configured to control a recording operation so as to move the recording head and the recording medium relative to each other in a direction intersecting the predetermined direction and discharge the ink from the recording head onto the recording medium according to the complementary data, wherein, if at least one discharge port among the plurality of ink discharge ports is identified as the defective discharge port, the complementing unit generates the complementary data for causing a discharge port, configured to discharge at a complementing position that is one predetermined position of positions adjacent, on both side in the predetermined direction, to a position at which the at least one discharge port discharges the ink, to discharge ink, and wherein, if the tone value indicated by the tone data indicates a tone value equal to or lower than the maximum tone value, the determination unit determines not to discharge the ink at all of the complementing positions.

* * * * *